US007084558B2

(12) United States Patent
Teramura et al.

(10) Patent No.: US 7,084,558 B2
(45) Date of Patent: Aug. 1, 2006

(54) SPARK PLUG AND METHOD FOR MANUFACTURING THE SPARK PLUG

(75) Inventors: Hideki Teramura, Mie (JP); Tomoaki Kato, Aichi (JP); Kazuyoshi Torii, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 182 days.

(21) Appl. No.: 10/465,552

(22) Filed: Jun. 20, 2003

(65) Prior Publication Data

US 2004/0041506 A1 Mar. 4, 2004

(30) Foreign Application Priority Data

Jun. 21, 2002 (JP) ..... 2002-181982

(51) Int. Cl.
*H01T 13/20* (2006.01)
*H01T 13/22* (2006.01)

(52) U.S. Cl. ..... 313/141; 445/7; 313/144

(58) Field of Classification Search ..... 313/141, 313/144

See application file for complete search history.

(56) References Cited

U.S. PATENT DOCUMENTS 4,261,085 A * 4/1981 Nishio et al. ..... 445/7
4,581,558 A * 4/1986 Takamura et al. ..... 313/141
4,700,103 A * 10/1987 Yamaguchi et al. ..... 313/141
4,743,793 A * 5/1988 Toya et al. ..... 313/141
5,456,624 A * 10/1995 Moore et al. ..... 445/7
5,465,022 A 11/1995 Katoh et al.
5,558,575 A 9/1996 Chiu et al.
5,563,469 A * 10/1996 Takamura et al. ..... 313/141
5,767,613 A * 6/1998 Kunt ..... 313/141
5,967,122 A * 10/1999 Muntzer et al. ..... 123/486
6,346,766 B1 2/2002 Kanao et al.

(Continued)

FOREIGN PATENT DOCUMENTS

GB 2356593 A 5/2001

(Continued)

OTHER PUBLICATIONS

European Search Report for EP 03 25 3876 dated Oct. 2, 2003.

*Primary Examiner*—Mariceli Santiago
*Assistant Examiner*—Anthony Perry
(74) *Attorney, Agent, or Firm*—Sughrue Mion, PLLC

(57) ABSTRACT

A ground-electrode spark portion 32 is formed from a noble metal which contains Pt as a main component, and is joined to a main metal portion of the ground electrode 4 via an alloy layer which has a thickness ranging from 0.5 μm to 100 μm and in which the noble metal that constitutes the ground-electrode spark portion 32 and the metal that constitutes the main metal portion of the ground electrode 4 are alloyed with each other. The ground-electrode spark portion 32 is configured such that a distal end surface 32*t* facing a spark discharge gap g is smaller in diameter than a bottom surface 32*u* joined to the ground electrode 4; and the distal end surface 32*t* is protrusively located beyond the side surface 4*s* of the ground electrode 4. When the ground-electrode spark portion 32 is viewed in plane from the distal end surface 32*t*, a portion of the surface of the ground-electrode spark portion 32 is viewed as a peripheral exposed-region surface 32*p* which is exposed on the side surface 4*s* of the ground electrode 4 so as to surround the distal end surface 32*t*.

9 Claims, 19 Drawing Sheets

U.S. PATENT DOCUMENTS

2001/0030495 A1 10/2001 Kanao et al.

FOREIGN PATENT DOCUMENTS

| | | | |
|---|---|---|---|
| JP | 3-176979 | | 7/1991 |
| JP | 03-176979 | A | 7/1991 |
| JP | 5-275157 | | 10/1993 |
| JP | 2000-277231 | A | 10/2000 |
| JP | 2001-126845 | A | 5/2001 |
| JP | 3225626 | B2 | 8/2001 |
| JP | 2001-244042 | A | 9/2001 |
| JP | 2001-273965 | A | 10/2001 |
| JP | 2001-284012 | A | 10/2001 |

* cited by examiner

SPARK PLUG AND METHOD FOR MANUFACTURING THE SPARK PLUG

BACKGROUND OF THE INVENTION

1. Field of the Invention

The present invention relates to a spark plug, as well as to a method for manufacturing the same.

2. Description of the Related Art

In recent years, in response to increasing demand for high performance of an internal combustion engine such as an automobile gasoline engine, a spark plug used for providing ignition has been required to enhance ignition performance and to reduce discharge voltage. A reduction in the diameter of a spark portion of a center electrode is effective for enhancing ignition performance and reducing discharge voltage. Thus, many spark plugs have employed a structure in which a noble metal chip is joined to a diameter-reduced distal end of a center electrode so as to form a spark portion. However, recently, in order to enhance fuel economy and to cope with stricter exhaust gas regulations, the trend is toward lean air-fuel mixture (lean burn), and thus ignition conditions are growing increasingly severe. Under these circumstances, even a ground electrode, which is located deeper in a combustion chamber, is subjected to such a trial that a noble metal chip is joined to the ground electrode so as to form a spark portion which protrudes toward the distal end surface of a center electrode from the side surface of the ground electrode, and also the diameter of a distal end portion of the noble metal chip is reduced.

A prior application (Japanese Patent Application Laid-Open (kokai) No. H03-176979) filed by the present inventors discloses a specific structure for reducing the diameter of a noble metal spark portion of a ground electrode. In the spark plug shown in FIG. 2 of the publication, a cylindrical chip of Ir or an Ir alloy having a small diameter is electrically welded (resistance-welded) to an Ni-based electrode base metal directly or via an intermediate layer of Pt-based metal. The chip is subjected to electric welding whereby the chip enters a state in which the chip can be deformed through machining. In this state, through application of pressure, a proximal portion (joint-side portion) of the chip is deformed, whereby a flange portion is formed. Formation of the flange portion increases a joining area, whereby the small-diameter chip can be joined with sufficient strength. This is the gist of the prior invention.

However, the subsequent studies have revealed that, in order to join a noble metal to an electrode with sufficient strength, an alloy layer having a certain thickness or greater must be formed between the noble metal chip and a main metal portion of the ground electrode to which the chip is to be joined. Ir, which is used as material for the noble metal chip in the prior invention, has a high melting point equal to or higher than 2,400° C. Thus, in order to form the alloy layer, resistance heating to a considerably high temperature is required. However, an Ni-based electrode base metal and an intermediate layer of Pt-based metal, which constitute the main metal portion of the ground electrode, have melting points far lower than that of Ir (melting point of Ni: 1,453° C.; and melting point of Pt: 1,769° C). Therefore, when resistance heating to a temperature required for alloying with Ir is performed, as shown in FIG. 13 of the accompanying drawings, the main metal portion of a ground electrode 4 is excessively softened and significantly deformed as compared with a noble metal chip 32'; hence, formation of a normal spark portion becomes very difficult. Also, since the ground electrode 4 is significantly softened, the ground electrode 4 fails to sufficiently receive a compressive deformation force exerted on a proximal portion (joint-side portion) of the noble metal chip 32'. As a result, a flange portion 32*t* is not spread to an expected degree, and most of the flange portion is highly likely to be buried in the ground electrode 4. The thus-obtained spark portion 32 is formed such that, since the flange portion 32*t* fails to have a sufficient width or is buried in the electrode, its proximal end part protruding from the ground electrode 4 (a protruding proximal end part) is unavoidably surrounded by an exposed surface of an electrode base metal 4, whose melting point is low.

As shown in FIG. 14 of the accompanying drawings, conceivably, as in the case of a center electrode, the Ir-based noble metal chip 32' may be joined to the ground electrode 4 through laser welding. However, as shown in FIG. 14, when laser welding is used, a weld bead WB, which serves as a joint portion, is formed around a protruding proximal part of the obtained spark portion 32 while having a considerable width (e.g., 0.2 mm or greater). Since a laser beam LB causes heat concentration, the weld bead WB is formed in the following manner: the electrode base metal and the noble metal chip 32' are fused together, followed by solidification. Thus, the weld bead WB is formed while eroding a considerable portion of the noble metal chip 32'. Since the weld bead WB contains a large amount of electrode base metal, which is, for example, an Ni-based metal, the weld bead WB is significantly lower in melting point than the spark portion 32 formed from an Ir-based metal. That is, a protruding proximal end part of the obtained spark portion 32 is surrounded by the weld bead WB of low melting point.

It must be noted that, when the diameter of the spark portion 32 of the ground electrode 4 is reduced, the following phenomenon is apt to arise. In recent years, in order for an internal combustion engine to enhance fuel economy and to practice lean burn, fuel injection pressure is increased, and employment of a direct-injection-type engine, in which fuel is injected directly into a combustion chamber, is increasingly common. Hence, a gas flow in a combustion chamber is considerably turbulent. When the diameter of the spark portion 32 is reduced in order to enhance ignition performance or other purposes, the area of a distal end surface of the spark portion 32, on which surface sparks land, decreases. As shown in FIG. 15 of the accompanying drawings, when sparking is subjected to a strong, lateral gas flow, the spark SP drifts and runs off the distal end surface of the spark portion 32; as a result, the spark is apt to land on a peripheral electrode surface which surrounds the protruding proximal end part. At this time, if, as shown in FIG. 13 or 14, the peripheral electrode surface is of the electrode base metal or weld bead WB, which are lower in melting point than the spark portion 32, the landing portion is eroded through spark ablation as shown in FIG. 15, thereby causing uneven ablation and thus raising a problem that the life of the ground electrode 4 is terminated at an early stage.

SUMMARY OF THE INVENTION

An object of the present invention is to provide a spark plug in which a noble metal spark portion is protrusively formed on a ground electrode and which is configured such that, even when used in an environment where a spark is apt to drift under a gas flow, the ground electrode is unlikely to suffer uneven ablation, as well as a method for manufacturing the spark plug.

To achieve the above object, a spark plug of the present invention is configured in the following manner:

a ground-electrode spark portion fixedly attached to a side surface of a ground electrode is disposed to face a center-electrode spark portion made from a noble metal and fixedly attached to a distal end of a center electrode, thereby forming a spark discharge gap between the center-electrode spark portion and the ground-electrode spark portion;

the ground-electrode spark portion is formed from a noble metal which contains Pt as a main component, and is joined to the ground electrode via an alloy layer which has a thickness ranging from 0.5 μm to 100 μm and in which the noble metal that constitutes the ground-electrode spark portion and a metal that constitutes the ground electrode are alloyed with each other; and the ground-electrode spark portion is configured such that the distal end surface facing the spark discharge gap is smaller in diameter than a bottom surface fixedly attached to the ground electrode; the distal end surface is protrusively located closer to the distal end of the center electrode than is the side surface of the ground electrode; and when the ground-electrode spark portion is viewed in plane from the distal end surface, a portion of a surface of the ground-electrode spark portion is viewed as a peripheral exposed-region surface which is exposed on the side surface of the ground electrode so as to surround the distal end surface.

Notably, herein, the term "main component" means a component whose content is the highest in the material concerned.

In the above-described spark plug of the present invention, the ground-electrode spark portion assumes such a shape that the distal end surface is protrusively located closer to the distal end surface of the center electrode than is the side surface of the ground electrode and that the distal end surface is smaller in diameter than the bottom surface, thereby contributing to enhancement in ignition performance and a reduction in discharge voltage. Also, since the peripheral exposed-region surface, which serves as a peripheral region of the distal end surface of the ground-electrode spark portion, is of a noble metal, even when a spark drifts under a gas flow and runs off the distal end surface of the ground-electrode spark portion, the peripheral exposed-region surface of a noble metal receives the spark, thereby preventing uneven ablation of the electrode.

The ground-electrode spark portion is formed from a noble metal which contains Pt as a main component, and is joined to the ground electrode via an alloy layer having a thickness ranging from 0.5 μm to 100 μm. Since the thickness of the alloy layer falls within the above-mentioned range, the noble metal surface, which serves as the peripheral exposed-region surface, is not excessively eroded by the alloy layer which is formed as a result of joining. As a result, a sufficiently wide noble metal surface is provided around the distal end surface of the ground-electrode spark portion, thereby providing an advantage in terms of prevention of uneven ablation. Notably, herein, the term "thickness of the alloy layer" means a distance as measured along a direction perpendicular to the boundary surface between the ground-electrode spark portion and the alloy layer.

In the case where the ground-electrode spark portion is formed by joining a noble metal chip to the ground electrode, the above-mentioned thickness range of the alloy layer for establishing a joint is very difficult to attain by means of laser welding, which forms a relatively wide weld bead, but is easily attained by employing a resistance welding process. In contrast to the spark plug which is disclosed in above-mentioned Japanese Patent Application Laid-Open (kokai) No. H03-176979 and in which the ground-electrode spark portion is formed from an Ir-based metal, according to the first configuration of the spark plug of the present invention, the ground-electrode spark portion is formed from a noble metal which contains Pt as a main component, the metal being lower in melting point than the Ir-based metal, whereby joining can be performed by resistance welding without encountering any problem.

When the thickness of the alloy layer is less than 0.5 μm, the joining strength of the ground-electrode spark portion becomes insufficient, and thus separation of the spark portion or the like becomes likely to arise. When resistance welding under ordinary conditions is employed, an alloy layer having a thickness of, for example, about 0.1 μm to 1 μm is formed. However, by performing a thermal diffusion process after resistance welding, the thickness of the alloy layer can be increased to about 100 μm. However, increasing the thickness to 100 μm or greater involves an increase in thermal treatment time, thereby impairing manufacturing efficiency.

The ground-electrode spark portion can be formed such that its proximal end part including the bottom surface is embedded in the ground electrode. Such embedment of the proximal end part of the ground-electrode spark portion further enhances the joining strength of the spark portion. In this case, the alloy layer is formed to surround the side surface of the embedded proximal end part of the spark portion. When the thickness of the alloy layer is in excess of 100 μm, the alloy layer excessively erodes a peripheral edge portion of the peripheral exposed-region surface of the spark portion, thereby reducing the real width of the peripheral exposed-region surface. As a result, the effect of preventing uneven ablation of the electrode becomes insufficient.

Herein, the term "alloy layer" is defined as a region which has the composition described below. CPt1 represents the Pt concentration of a portion of a noble metal chip attached through welding for forming a spark portion, the portion being free from a change in composition induced by welding. CPt2 represents the Pt concentration of a portion of a ground electrode, the noble metal chip being welded to the ground electrode and the portion being free from a change in composition induced by the welding. The alloy layer is defined as a portion of a region formed between the ground electrode and the ground-electrode spark portion and having an intermediate Pt concentration between the Pt concentration of the ground electrode and that of the ground-electrode spark portion, the portion having a Pt concentration represented by CPt3 and satisfying $$0.2(CPt1-CPt2)+CPt2 \leqq CPt3 \leqq 0.8(CPt1-CPt2)+CPt2.$$

Notably, the above-mentioned Pt concentration can be determined by a known analytic method; for example, Electron Probe Micro Analysis (EPMA). For example, the ground-electrode spark portion and its peripheral portion are cut by a plane which passes through the geometric barycenter position of the distal end surface of the ground-electrode spark portion and which includes a straight line in parallel with the axis of the center electrode. The distribution of Pt concentration on the section thus obtained is measured by means of line or surface analysis conducted through EPMA, whereby an alloy layer can be identified.

To achieve the above object, a spark plug of the present invention is configured in the following manner:

a ground-electrode spark portion fixedly attached, via a relaxation metal portion, to a side surface of a ground electrode is disposed to face a center-electrode spark portion made from a noble metal and fixedly attached to a distal end of a center electrode, thereby forming a spark discharge gap between the center-electrode spark portion and the ground-electrode spark portion;

the ground-electrode spark portion is formed from a noble metal which contains Pt as a main component, and the relaxation metal portion is formed from a metal having a coefficient of linear expansion falling between that of a metal that constitutes the ground electrode and that of the noble metal that constitutes the ground-electrode spark portion;

a first alloy layer which has a thickness ranging from 0.5 μm to 100 μm and in which the noble metal that constitutes the ground-electrode spark portion and the metal that constitutes the relaxation metal portion are alloyed with each other is formed between the ground-electrode spark portion and the relaxation metal portion; and the ground-electrode spark portion is configured such that the distal end surface facing the spark discharge gap is smaller in diameter than a bottom surface fixedly attached to the relaxation metal portion; the distal end surface is protrusively located closer to the distal end of the center electrode than is the side surface of the ground electrode; and when the ground-electrode spark portion is viewed in plane from the distal end surface, a portion of a surface of the ground-electrode spark portion is viewed as a peripheral exposed-region surface which is exposed on the side surface of the ground electrode so as to surround the distal end surface.

In the above-described spark plug of the present invention, the ground-electrode spark portion assumes such a shape that the distal end surface is protrusively located closer to the distal end surface of the center electrode than is the side surface of the ground electrode and that the distal end surface is smaller in diameter than the bottom surface, thereby contributing to enhancement in ignition performance and a reduction in discharge voltage. Also, since the peripheral exposed-region surface, which serves as a peripheral region of the distal end surface of the ground-electrode spark portion, is of a noble metal, even when a spark drifts under a gas flow and runs off the distal end surface of the ground-electrode spark portion, the peripheral exposed-region surface of a noble metal receives the spark, thereby preventing uneven ablation of the electrode.

The ground-electrode spark portion is formed from a noble metal which contains Pt as a main component; the relaxation metal portion is formed from a metal having a coefficient of linear expansion falling between that of a metal that constitutes the ground electrode and that of the noble metal that constitutes the ground-electrode spark portion; and the first alloy layer which has a thickness ranging from 0.5 μm to 100 μm and in which the noble metal that constitutes the ground-electrode spark portion and the metal that constitutes the relaxation metal portion are alloyed with each other is formed between the ground-electrode spark portion and the relaxation metal portion. Since the thickness of the first alloy layer falls within in the above-mentioned range, the noble metal surface, which serves as the peripheral exposed-region surface, is not excessively eroded by the first alloy layer which is formed as a result of joining. As a result, a sufficiently wide noble metal surface is provided around the distal end surface of the ground-electrode spark portion, thereby providing an advantage in terms of prevention of uneven ablation. Notably, herein, the term "thickness of the first alloy layer" means a distance as measured along a direction perpendicular to the boundary surface between the ground-electrode spark portion and the first alloy layer.

In the case where the ground-electrode spark portion is formed by joining a noble metal chip to the ground electrode, the above-mentioned thickness range of the first alloy layer for establishing a joint is very difficult to attain by means of laser welding, which forms a relatively wide weld bead, but is easily attained by employing a resistance welding process. Furthermore, the ground-electrode spark portion is formed from a noble metal which contains Pt as a main component, Pt being lower in melting point than Ir, whereby joining can be performed by resistance welding without encountering any problem.

When the thickness of the first alloy layer is less than 0.5 μm, the joining strength of the ground-electrode spark portion becomes insufficient, and thus separation of the spark portion or the like becomes likely to arise. When resistance welding under ordinary conditions is employed, a first alloy layer having a thickness of, for example, about 0.1 μm to 1 μm is formed. However, by performing a thermal diffusion process after resistance welding, the thickness of the first alloy layer can be increased to about 100 μm. However, increasing the thickness to 100 μm or greater involves an increase in thermal treatment time, thereby impairing manufacturing efficiency.

The ground-electrode spark portion can be formed such that its proximal end part including the bottom surface is embedded in the relaxation metal portion. Such embedment of the proximal end part of the ground-electrode spark portion further enhances the joining strength of the spark portion. In this case, the first alloy layer is formed in such a manner as to surround the side surface of the embedded proximal end part of the spark portion. When the thickness of the first alloy layer is in excess of 100 μm, the first alloy layer excessively erodes a peripheral edge portion of the peripheral exposed-region surface of the spark portion, thereby reducing the real width of the peripheral exposed-region surface. As a result, the effect of preventing uneven ablation of the electrode becomes insufficient.

Herein, the term "first alloy layer" is defined as a region which has the composition described below. CPt4 represents the Pt concentration of a portion of a noble metal chip attached by welding for forming a spark portion, the portion being free from a change in composition induced by welding. CPt5 represents the Pt concentration of a part of a relaxation metal portion, the noble metal chip being welded to the relaxation metal portion and the part being free from a change in composition induced by the welding. The first alloy layer is defined as a portion of a region formed between the relaxation metal portion and the ground-electrode spark portion and having an intermediate Pt concentration between the Pt concentration of the relaxation metal portion and that of the ground-electrode spark portion, the portion having a Pt concentration represented by CPt6 and satisfying $$0.2(CPt4-CPt5)+CPt5 \leqq CPt6 \leqq 0.8(CPt4-CPt5)+CPt5.$$

Notably, the above-mentioned Pt concentration can be determined by a known analytic method; for example, Electron Probe Micro Analysis (EPMA). For example, the ground-electrode spark portion and its peripheral portion are cut by a plane which passes through the geometric barycenter position of the distal end surface of the ground-electrode spark portion and which includes a straight line in parallel with the axis of the center electrode. The distribution of Pt concentration on the section thus obtained is measured by means of line or surface analysis conducted through EPMA, whereby the first alloy layer can be identified.

Preferably, when G represents the shortest distance along the axial direction of the center electrode between the distal end surface of the center-electrode spark portion and the distal end surface of the ground-electrode spark portion, and L represents the length of a line segment connecting, by the shortest distance, the peripheral edge of the distal end surface of the center-electrode spark portion and the peripheral edge of the peripheral exposed-region surface, the spark plug of the present invention satisfies the following relational expression:

$$1.3G \leqq L \leqq 3G \quad (1)$$

Preferably, when, in orthogonal projection on a plane perpendicularly intersecting the axis of the center electrode, A represents the width of the peripheral exposed-region surface, W represents the width of the ground electrode, and d represents the diameter of the distal end surface of the ground-electrode spark portion , the spark plug of the present invention satisfies the following relational expression:

$$0.15 \leqq A \leqq \{(W-d)/2\}-0.4 \text{(unit: mm)} \quad (2)$$

Notably, herein, the term "width of the peripheral exposed-region surface" means an average dimension of the peripheral exposed-region surface as measured, in the above-mentioned orthogonal projection, along a radial direction radiating from the geometric barycenter position of the distal end surface of the ground-electrode spark portion.

As shown in FIG. 2, when a peripheral edge 32*e* of a peripheral exposed-region surface 32*p* serves as a reference position with respect to the direction of an axis O of a center electrode 3, the above-mentioned dimension L is determined from a protrusive height t of a distal end surface 32*t* of a ground-electrode spark portion 32 as measured from the reference position, and a width A of the peripheral exposed-region surface 32*p*. Therefore, even when A is infinitesimally close to zero, L can be set to 1.3 times or more dimension G, which is equivalent to the length of a spark discharge gap g, through appropriately setting the protrusive height t of the distal end surface 32*t*. However, in this case, when a spark drifts and runs off the distal end surface 32*t*, the spark lands off the peripheral exposed-region surface 32*p*; thus, the effect of preventing uneven ablation of the ground electrode 4 is not obtained at all.

In this connection, the present inventors conducted experimental studies and found the following. When a spark drifts under a gas flow, the effect of preventing uneven ablation of the electrode through reception of the spark on the peripheral exposed-region surface is obtained particularly noticeably when the following two conditions are satisfied: the width A of the peripheral exposed-region surface is 0.15 mm or greater, and the above-defined G and L satisfy $1.3G \leqq L$.

When $A<0.15$, the effect of suppressing uneven ablation of the present invention fails to be yielded. Also, when $1.3G>L$, the effect of suppressing uneven ablation fails to be yielded.

When $A>\{(W-d)/2\}-0.4$, the size of a noble metal chip used to form the ground-electrode spark portion becomes too large, resulting in increased material cost and leading to a problem that the noble chip itself or a welding sag bulges in the width direction of the ground electrode. When $L>3G$, the protrusive height t of the distal end surface 32*t* becomes too great, or the width A of the peripheral exposed-region surface becomes too wide. In the former case, as a result of the ground-electrode spark portion becoming excessively high, heat release is impaired, and thus the temperature of the distal end of the spark portion increases excessively, leading to a problem that electrode ablation is accelerated to thereby cause early termination of spark plug life. The latter case involves the same problem as that in the case where $A>\{(W-d)/2\}-0.4$.

Preferably, a protrusive height t of the distal end surface of the ground-electrode spark portion assumes a value ranging from 0.3 mm to 1.5 mm as measured from the above-mentioned reference position. When the protrusive height t is greater than 1.5 mm, heat release is impaired, and thus the temperature of the distal end of the spark portion increases excessively, leading to a problem that electrode ablation is accelerated to thereby cause early termination of spark plug life. When the protrusive height t is less than 0.3 mm, the effect of enhancing ignition performance through protrusion of the spark portion becomes insufficient. Notably, a plane which includes the peripheral edge of the peripheral exposed-region surface serves as the reference position.

In view of enhancement of ignition performance, further preferably, the distal end surface of the ground-electrode spark portion has a protrusive height H equal to or greater than 0.5 mm as measured from the side surface of the ground electrode. In this case, the protrusive height H from the side surface of the ground electrode is set such that the protrusive height t from the reference position is not in excess of 1.5 mm. Notably, the protrusive height H is measured from a flat surface region of the side surface of the ground electrode, the flat surface region being a region which remains after exclusion of an elevated portion which is formed around the ground-electrode spark portion as a result of the noble metal chip being joined to the ground electrode.

Preferably, the diameter d of the distal end surface of the ground-electrode spark portion assumes a value ranging from 0.3 mm to 0.9 mm. When the diameter d is less than 0.3 mm, ablation of the ground-electrode spark portion becomes too intensive, potentially leading to a problem of early termination of spark plug life. When the diameter d is in excess of 0.9 mm, the effect of enhancing ignition performance becomes insufficient.

Preferably, the entire peripheral exposed-region surface is located closer to the center electrode than is the side surface of the ground electrode. By employing this feature, the distance between the distal end surface of the center-electrode spark portion and the peripheral exposed-region surface becomes shorter than that between the distal end surface of the center-electrode spark portion and the side surface of the ground electrode, whereby sparking to the ground electrode does not occur, thereby preventing uneven ablation of the electrode.

Next, the present invention provides a method for manufacturing a spark plug wherein a ground-electrode spark portion made from a noble metal and fixedly attached to a side surface of a ground electrode is disposed to face a center-electrode spark portion made from a noble metal and fixedly attached to a distal end of a center electrode, thereby forming a spark discharge gap between the center-electrode spark portion and the ground-electrode spark portion and wherein the ground-electrode spark portion is configured such that the distal end surface facing the spark discharge gap is smaller in diameter than a bottom surface joined to the relaxation metal portion; the distal end surface is protrusively located closer to a distal end surface of the center electrode than is the side surface of the ground electrode; and when the ground-electrode spark portion is viewed in plane from the distal end surface, a portion of a surface of the ground-electrode spark portion is viewed as a peripheral exposed-region surface which is exposed on the side surface of the ground electrode so as to surround the distal end surface. The method is characterized by comprising:

a chip manufacturing step for manufacturing a noble metal chip, which is to serve as the ground-electrode spark portion and in which a distal end surface is smaller in diameter than a bottom surface, by machining a noble metal which contains Pt as a main component, prior to joining the noble metal chip to the ground electrode; and a resistance welding step in which the manufactured noble metal chip is placed on the ground electrode such that the bottom surface is in contact with the ground electrode; and the noble metal chip and the ground electrode are joined by resistance welding while a force for bringing the noble metal chip and the ground electrode into close contact with each other is selectively applied to a chip surface which serves as a peripheral region of the distal end surface when the noble metal chip is viewed in plane from the distal end surface.

According to the method employed in Japanese Patent Application Laid-Open (kokai) No. H03-176979, in order to form a ground-electrode spark portion having a peripheral exposed-region surface, a proximal end portion of an Ir-based noble metal chip is compressively deformed at the time of resistance welding so as to form a flange portion. However, since the melting point of an Ir-based metal is high, an insufficient joint results, and compressively deforming the chip is practically difficult. As a result, the flange portion cannot be formed sufficiently, and in turn the peripheral exposed-region surface cannot be formed sufficiently. In order to cope with the problem, according to the above-described method of the present invention, a noble metal chip which is to serve as the ground-electrode spark portion and in which the distal end surface is smaller in diameter than the bottom surface is manufactured beforehand through machining (performing plastic working, such as header working, on) a noble metal which contains Pt as a main component. The thus-manufactured noble metal chip is placed on the ground electrode, followed by resistance welding. Since the peripheral exposed-region surface can be sufficiently provided at the stage of manufacturing the chip, there is no need to deform the chip during resistance welding. Since the ground-electrode spark portion is not formed from an Ir-based metal, but is formed from a Pt-based metal, whose melting point is low, a good joint condition can be obtained easily by resistance welding. Furthermore, since the noble metal chip and the ground electrode are joined by resistance welding while a force for bringing the noble metal chip and the ground electrode into close contact with each other is selectively applied to a chip surface which serves as a peripheral region of the distal end surface (i.e., a portion which is to become the peripheral exposed-region surface), there is no fear of the distal end surface of the spark portion being damaged or deformed during welding.

The present invention further provides a method for manufacturing a spark plug wherein a ground-electrode spark portion made from a noble metal and fixedly attached, via a relaxation metal portion, to a side surface of a ground electrode is disposed to face a center-electrode spark portion made from a noble metal and fixedly attached to a distal end of a center electrode, thereby forming a spark discharge gap between the center-electrode spark portion and the ground-electrode spark portion and wherein the ground-electrode spark portion is configured such that the distal end surface facing the spark discharge gap is smaller in diameter than a bottom surface joined to the relaxation metal portion; the distal end surface is protrusively located closer to a distal end surface of the center electrode than is the side surface of the ground electrode; and when the ground-electrode spark portion is viewed in plane from the distal end surface, a portion of a surface of the ground-electrode spark portion is viewed as a peripheral exposed-region surface which is exposed on the side surface of the ground electrode so as to surround the distal end surface. The method comprises:

a chip manufacturing step for manufacturing a noble metal chip, which is to serve as the ground-electrode spark portion and in which a distal end surface is smaller in diameter than a bottom surface, by machining a noble metal which contains Pt as a main component, prior to joining the noble metal chip to the ground electrode; and a joining step in which a second noble metal chip which is to serve as the relaxation metal portion and whose coefficient of linear expansion falls between that of a metal that constitutes the ground electrode and that of the noble metal that constitutes the ground-electrode spark portion is placed on the bottom surface of the manufactured noble metal chip; and the second noble metal chip and the manufactured noble metal chip are joined to form a first alloy layer which has a thickness ranging from 0.5 μm to 100 μm and in which the metal that constitutes the second noble metal chip and the metal that constitutes the manufactured noble metal chip are alloyed with each other.

A noble metal chip which is to serve as the ground-electrode spark portion and in which the distal end surface is smaller in diameter than the bottom surface is manufactured beforehand by machining (performing plastic working, such as header working, on) a noble metal which contains Pt as a main component. The thus-manufactured noble metal chip is placed on the second noble metal chip, followed by resistance welding. Since the peripheral exposed-region surface can be sufficiently provided at the stage of manufacturing the chip, there is no need to deform the chip during resistance welding. Since the ground-electrode spark portion is not formed from an Ir-based metal, but is formed from a Pt-based metal, whose melting point is low, a good joint condition can be obtained easily by resistance welding. Furthermore, the noble metal chip is joined to the second noble metal chip whose coefficient of linear expansion falls between that of the metal that constitutes the ground electrode and that of the noble metal that constitutes the ground-electrode spark portion, whereby the joining process can be further facilitated.

Figure 1:
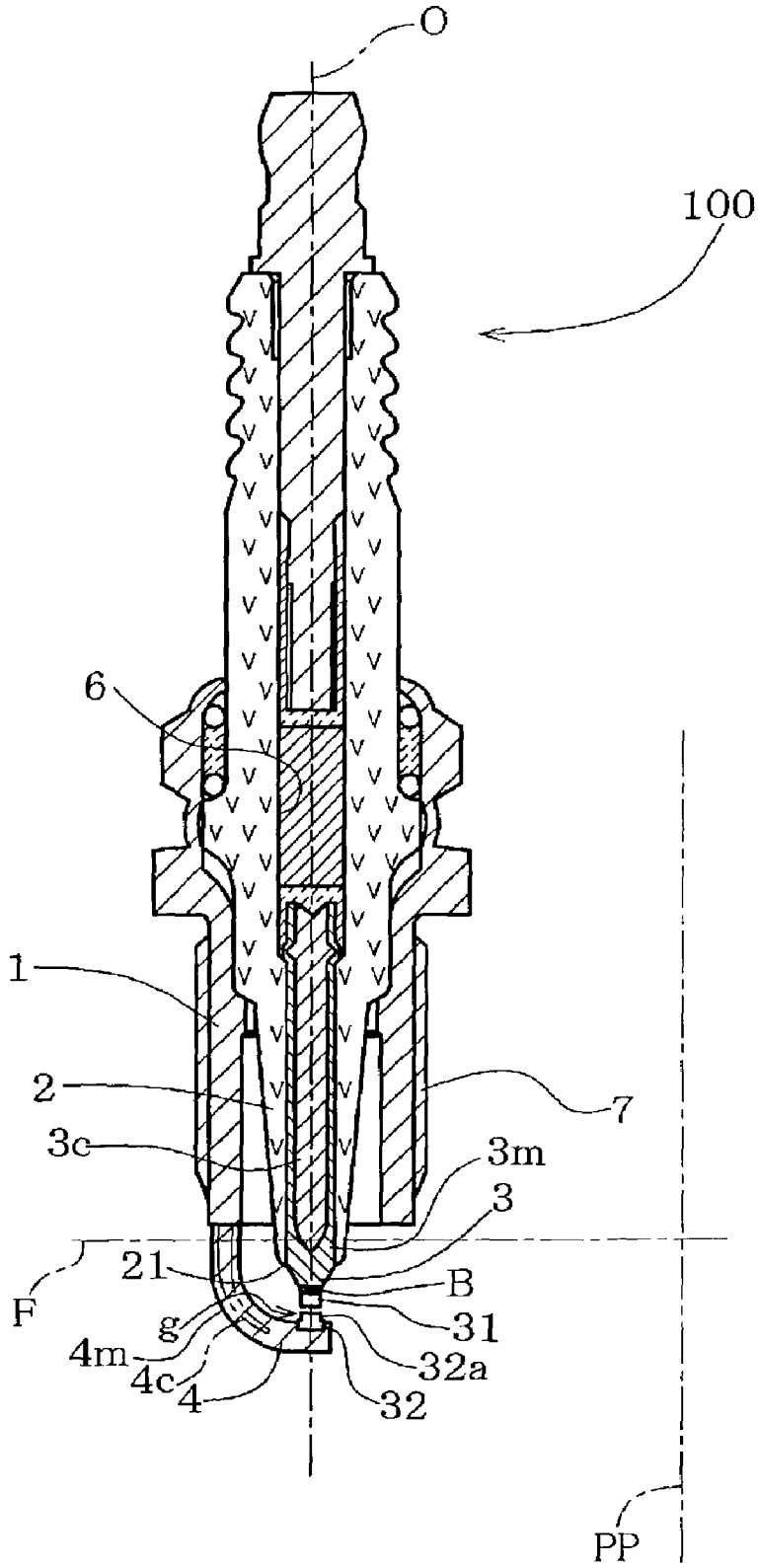
FIG. 1 is a sectional side view showing a spark plug 100 of the first embodiment of the present invention.

Reference numerals are used to identify items shown in the drawings as follows:

3: center electrode
4: ground electrode
4*s*: side surface
4*m*: electrode base metal
31: center-electrode spark portion
32: ground-electrode spark portion
32*t*: distal end surface
32*u*: bottom surface
32*p*: peripheral exposed-region surface
g: spark discharge gap
40: alloy layer
41: relaxation metal portion
100: spark plug

DETAILED DESCRIPTION OF THE PREFERRED EMBODIMENTS

The present invention will now be described in greater detail by reference to the accompanying drawings which should not be construed as limiting the invention.

Figure 2:
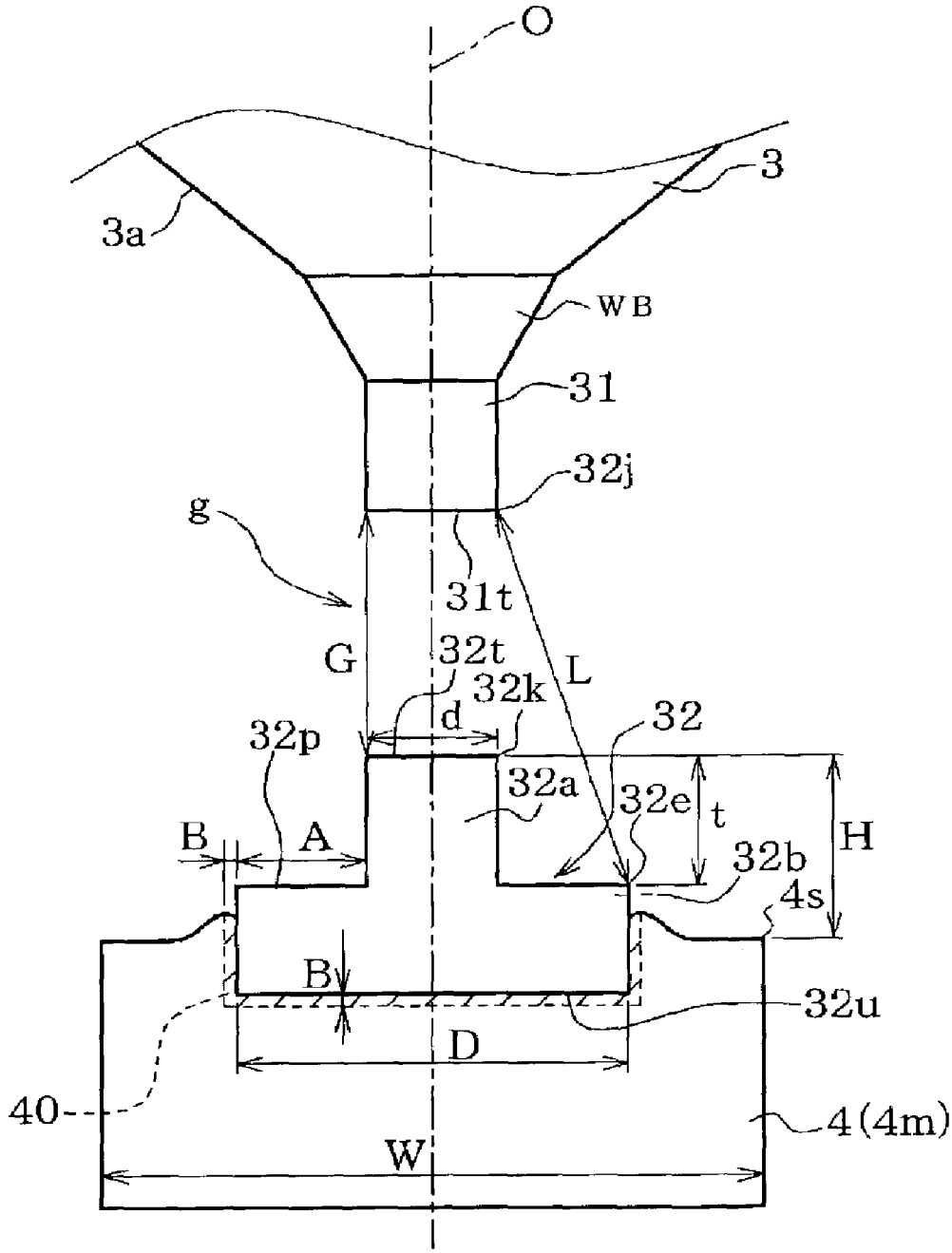
FIG. 2 is an enlarged front view showing a main portion of FIG. 1.

FIG. 1 shows a spark plug according to a first embodiment to which the manufacturing method of the present invention is applied. FIG. 2 is an enlarged view showing a main portion of the spark plug. A spark plug 100 includes a tubular metallic shell 1; an insulator 2, which is fitted into the metallic shell 1 such that a distal end portion 21 protrudes from the metallic shell 1; a center electrode 3, which is disposed in the insulator 2 such that a distal end portion thereof protrudes from the insulator 2; and a ground electrode 4, one end of which is joined to the metallic shell 1 through welding or the like and the other end of which is bent sideward such that a side surface thereof faces a distal end portion (herein, a distal end surface) of the center electrode 3. A noble metal chip formed from a Pt-based metal is resistance-welded to the side surface 4*s* of the ground electrode 4, thereby providing a ground-electrode spark portion 32. A noble metal chip formed from an Ir-based metal is laser-welded to the distal end of the center electrode 3, thereby providing a center-electrode spark portion 31. A spark discharge gap g is formed between the ground-electrode spark portion 32 and the center-electrode spark portion 31.

The ground-electrode spark portion 32 may be formed from pure Pt. However, in order to enhance spark ablation resistance, the ground-electrode spark portion 32 can be formed from a Pt alloy which contains Pt as a main component (a component of highest content) and one or two components selected from the group consisting of Ir and Ni, as an additional component(s) in a total amount of 5%–50% by mass. The center-electrode spark portion 31 can be formed from an Ir alloy which contains Ir as a main component and one or more components selected from the group consisting of Pt, Rh, Ru, and Re, as an additional component(s) for suppressing oxidational volatilization of Ir and enhancing workability in a total amount of 3%–50% by mass.

The insulator 2 is formed from, for example, an alumina or aluminum nitride ceramic sintered body, and has a hole portion 6 formed therein along its axial direction and adapted to receive the center electrode 3. The metallic shell 1 is formed into a tubular shape from a metal such as low-carbon steel; serves as a housing of the spark plug 100; and has a male-threaded portion 7 formed on its outer circumferential surface and adapted to mount the plug 100 to an unillustrated engine block.

At least surface layer portions (hereinafter, called an electrode base metal) 4*m* and 3*m* of the ground electrode 4 and the center electrode 3, respectively, are formed from an Ni alloy. Specific examples of the Ni alloy include INCONEL 600 (trademark) (Ni: 76% by mass, Cr: 15.5% by mass, Fe: 8% by mass (balance: trace additive element or impurities)) and INCONEL 601 (trademark) (Ni: 60.5% by mass, Cr: 23% by mass, Fe: 14% by mass (balance: trace additive element or impurities)). In the ground electrode 4 and the center electrode 3, heat transfer acceleration elements 4*c* and 3*c* formed from Cu or a Cu alloy are embedded in the electrode base metals 4*m* and 3*m*, respectively.

As shown in FIG. 2, a distal end portion 3*a* of the center electrode 3 is taperingly reduced in diameter. A noble metal chip is brought in contact with the end surface of the distal end portion 3*a*. Then, a weld bead WB is formed along a peripheral edge portion of the joint surface through laser welding, thereby forming the center-electrode spark portion 31.

Figure 5:
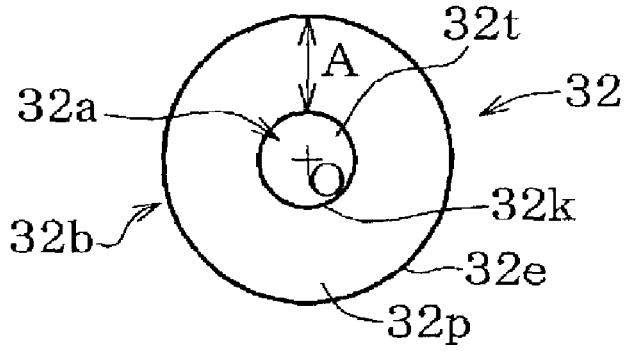
FIG. 5 is an enlarged plan view and enlarged side view showing a main portion of FIG. 2.
Figure 5:
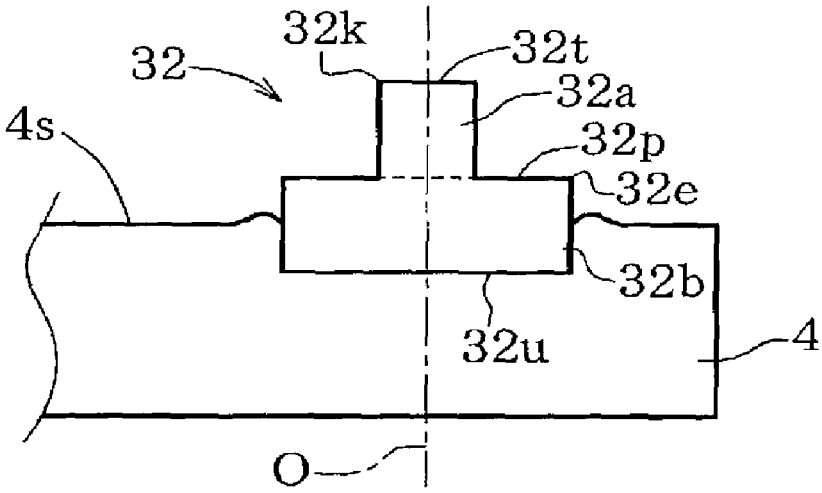

The ground-electrode spark portion 32 is joined to the electrode base metal 4*m* of the ground electrode 4 via an alloy layer 40 in which metals that constitute the two portions (the ground-electrode spark portion 32 and the electrode base metal 4*m*) are alloyed with each other. Thickness B of the alloy layer 40 assumes a value ranging from 0.5 μm to 100 μm. The ground-electrode spark portion 32 is configured such that a distal end surface 32*t* which faces the spark discharge gap g is smaller in diameter than a bottom surface 32*u* which is joined to the ground electrode 4 and such that the distal end surface 32*t* is protrusively located toward the spark discharge gap g as compared with the side surface 4*s* of the ground electrode 4. As shown in FIG. 5, when the ground-electrode spark portion 32 is viewed in plane from the distal end surface 32*t*, a portion of the surface of the ground-electrode spark portion 32 is viewed as a peripheral exposed-region surface 32*p* which is exposed, toward the distal end surface of the center electrode, on the side surface 4*s* of the ground electrode 4 in such a manner as to surround the distal end surface 32*t*.

In the first embodiment, the ground-electrode spark portion 32 includes a body portion 32*b* having the bottom surface 32*u;* a top surface 32*p* of the body portion 32*b;* and a protrusive portion 32*a* protruding from a central portion of the top surface 32*p*. The distal end surface 32*t* of the protrusive portion 32*a* faces a distal end surface 31*t* of the center-electrode spark portion 31, thereby forming the spark discharge gap g. As shown in FIG. 5, the body portion 32*b* and the protrusive portion 32*a* assume respective circular, planar forms which are disposed concentrically; and an annular region as viewed between a peripheral edge 32*e* of the top surface 32*p* and a peripheral edge 32*k* of the distal end surface 32*t* serves as a peripheral exposed-region surface. The outer circumferential surface of the protrusive portion 32*a* and that of the body portion 32*b* are cylindrical surfaces.

Next, as shown in FIG. 2, G represents the shortest distance (gap length) along the direction of the axis O of the center electrode 3 between the distal end surface 31*t* of the center-electrode spark portion 31 and the distal end surface 32*t* of the ground-electrode spark portion 32. L represents the length of a line segment connecting, by the shortest distance, a peripheral edge 32*j* of the distal end surface 31*t* of the center-electrode spark portion 31 and a peripheral edge 32*e* of the peripheral exposed-region surface 32*p*. These G and L are related to each other as represented by the following relational expression:

$$1.3G \leqq L \leqq 3G \quad (1)$$

According to the first embodiment, in orthogonal projection on a plane perpendicularly intersecting the axis O, the center of the distal end surface 31*t* of the center-electrode spark portion 31 and that of the distal end surface 32*t* of the ground-electrode spark portion 32 substantially coincide with each other. Also, the distal end surface 31*t* of the center-electrode spark portion 31 and the distal end surface 32*t* of the ground-electrode spark portion 32 face each other while extending in parallel with a plane which intersects perpendicularly with the axis O. The distance G is a face-to-face distance between the surfaces 31*t* and 32*t* as measured along the direction of the axis O between arbitrary positions on the surfaces 31*t* and 32*t*. The distance L can be measured as the length of a generator of the side surface of a truncated cone whose opposite end surfaces are represented by the distal end surface 31*t* of the center-electrode spark portion 31 and the top surface 32*p* of the body portion 32*b* of the ground-electrode spark portion 32.

In orthogonal projection on a plane perpendicularly intersecting the axis O of the center electrode 3 (see FIG. 5), A represents the width of the peripheral exposed-region surface 32*p,* W represents the width of the ground electrode W, and d represents the diameter of the distal end surface 32*t* of the ground-electrode spark portion 32. These A, W, and d are related to one another as represented by the following relational expression:

$$0.15 \leqq A \leqq \{(W-d)/2\} - 0.4 \text{(unit: mm)} \quad (2)$$

Notably, in the first embodiment, when D represents the diameter of the bottom surface 32*u* of the body portion 32*b,* A is equal to (D−d)/2. The width W of the ground electrode 4 is defined in the following manner. In FIG. 1, reference direction F is determined in such a manner as to intersect perpendicularly with the axis O of the center electrode 3 and to pass through the geometric barycenter position of a cross section of the ground electrode 4 cut, by a plane perpendicularly intersecting the axis O, at a position located 1 mm away from the end surface of the metallic shell 1 to which the ground electrode 4 is joined. A projection plane PP is determined in such a manner as to intersect perpendicularly with the reference direction F on the side opposite the position of the joined proximal end portion of the ground electrode 4 with respect to the axis O. As shown in FIG. 2, in orthogonal projection on the projection plane PP, the dimension of the ground electrode 4 as measured along the direction perpendicularly intersecting the axis O is defined as the width W.

The diameter d of the distal end surface 32*t* of the ground-electrode spark portion 32 assumes a value ranging from 0.3 mm to 0.9 mm. When the peripheral edge 32*e* of the peripheral exposed-region surface 32*p* serves as a reference position, protrusive height t of the distal end surface 32*t* of the ground-electrode spark portion 32 assumes a value ranging from 0.3 mm to 1.5 mm as measured from the reference position along the direction of the axis O of the center electrode 3. Protrusive height H of the distal end surface 32*t* as measured from the side surface 4*s* of the ground electrode 4 is equal to 0.5 mm or greater and is determined such that t is not in excess of 1.5 mm. The critical meaning of the above-mentioned numerical ranges is described above and repeated description thereof is omitted.

The ground-electrode spark portion 32 is disposed such that its proximal end part including the bottom surface 32*u* is embedded in the ground electrode 4 (electrode base metal 4*m*). The aforementioned alloy layer 40 is formed so as to surround the side surface of the embedded proximal end part. The alloy layer 40 is also formed between the bottom surface 32*u* and the electrode base metal 4*m*. At either portion, the thickness B of the alloy layer 40 assumes a value ranging from 0.5 μm to 100 μm.

Figure 3:
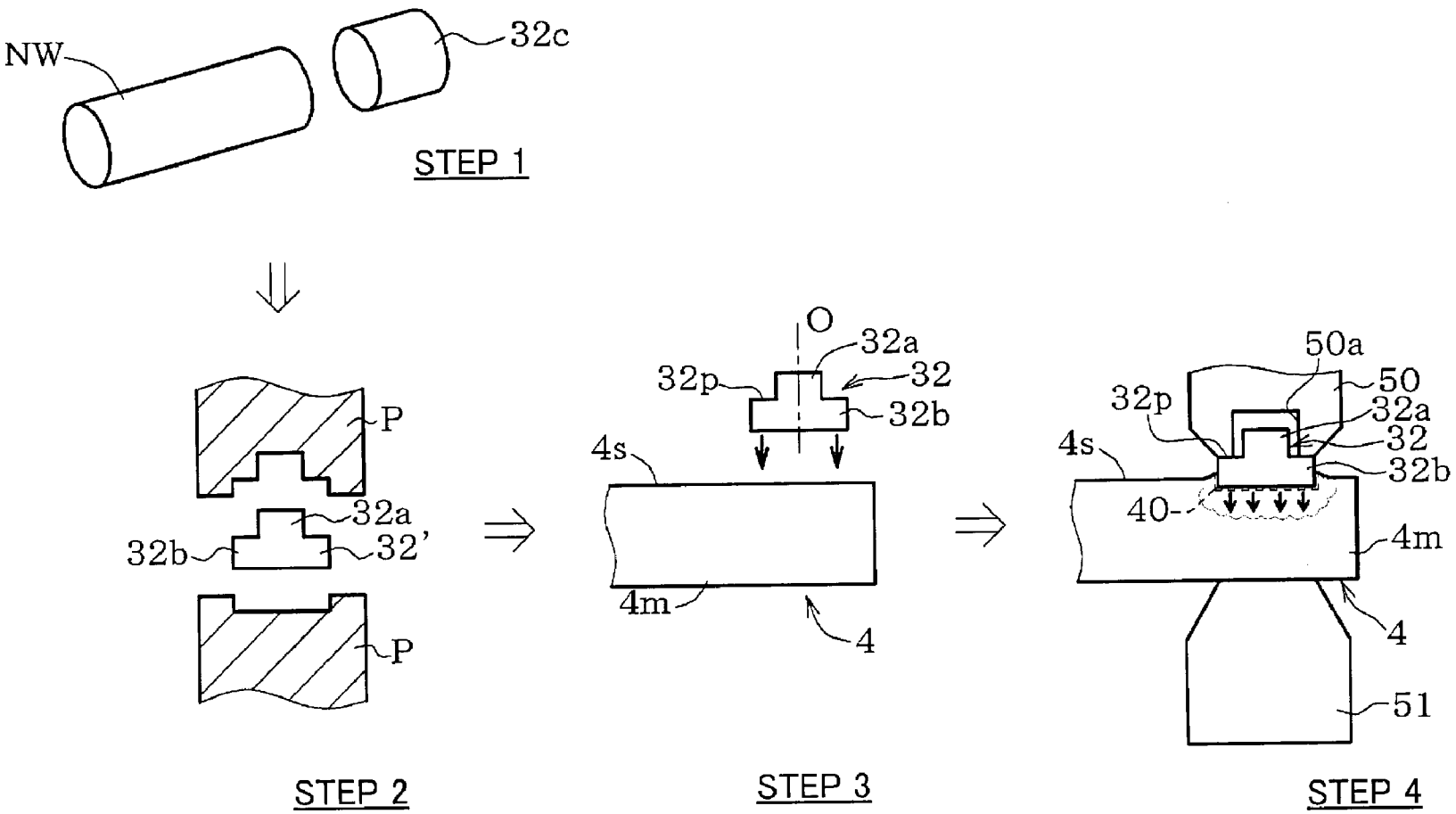
FIG. 3 is an explanatory view showing a process for manufacturing the spark plug 100 of the first embodiment of FIG. 1.

A process for manufacturing the spark plug 100 of the first embodiment will next be described. FIG. 3 shows a method for forming the ground-electrode spark portion 32. Specifically, as shown in Step 1, a disklike noble metal chip 32*c* for forming the ground-electrode spark portion 32 is prepared through cutting a noble metal material, e.g. a noble metal wire NW, which contains Pt as a main component (or through blanking from a plate material). Prior to joining to the ground electrode 4, as shown in Step 2, the disklike noble metal chip 32*c* is subjected to known header working by use of a die P, thereby yielding the noble metal chip 32' (including the body portion 32*b* and the protrusive portion 32*a*) for use in final joining.

As shown in Step 3, the thus-obtained noble metal chip 32' is placed on the side surface 4*s* of the ground electrode 4 (electrode base metal 4*m*) such that the bottom surface 32*u* is in contact with the side surface 4*s*. Then, as shown in Step 4, the resultant assembly is held under pressure between electrodes 50 and 51 and caused to generate heat through conduction of electricity. Hence, heat is generated between the noble metal chip 32' and the electrode base metal 4*m*. While the noble metal chip 32' is penetrating into the electrode base metal 4*m,* the alloy layer 40 is formed between the noble metal chip 32' and the electrode base metal 4*m* as a result of heat generation. Thus, the ground-electrode spark portion 32 is formed.

In this resistance welding, a force for bringing the noble metal chip 32' and the electrode base metal 4*m* into close contact with each other is selectively applied to the chip surface (a portion which is to become the peripheral exposed-region surface) 32*p* which serves as a peripheral region of the distal end surface 32*t* when the noble metal chip 32' is viewed in plane from the distal end surface 32*t*. In the present embodiment, a recess 50*a* is formed on a press member 50 (which also serves as an electrode for resistance welding) at a position corresponding to the noble metal chip 32', and the press member 50 selectively applies a pressing force to the top surface 32*p* (a peripheral region of the protrusive portion 32*a*) of the body portion 32*b* of the noble metal chip 32'. Another support member (which functions as an electrode) 51 is disposed on the opposite surface of the ground electrode 4. The ground electrode 4 and the noble metal chip 32' are held between the pressing member 50 and the support member 51 while a pressing force and electricity are applied thereto via the top surface 32*p*, whereby the alloy layer (resistance weld zone) 40 can be formed. Notably, the width A of the peripheral exposed-region surface 32*p* assuming a value equal to or greater than 0.15 mm is also favorable in view of securing a surface area through which the noble metal chip 32' is pressed by means of the press member 50 in performing resistance welding by the above-described method.

Next, a second embodiment of the present invention will be described with reference to FIG. 17. A spark plug of the second embodiment differs from the above-described spark plug 100 of the first embodiment mainly in that a relaxation metal portion is provided between a ground-electrode spark portion and a ground electrode. Therefore, the following description will be centered on structural features different from those of the spark plug 100 of the first embodiment, and description of similar features will be omitted or briefed.

Figure 17:
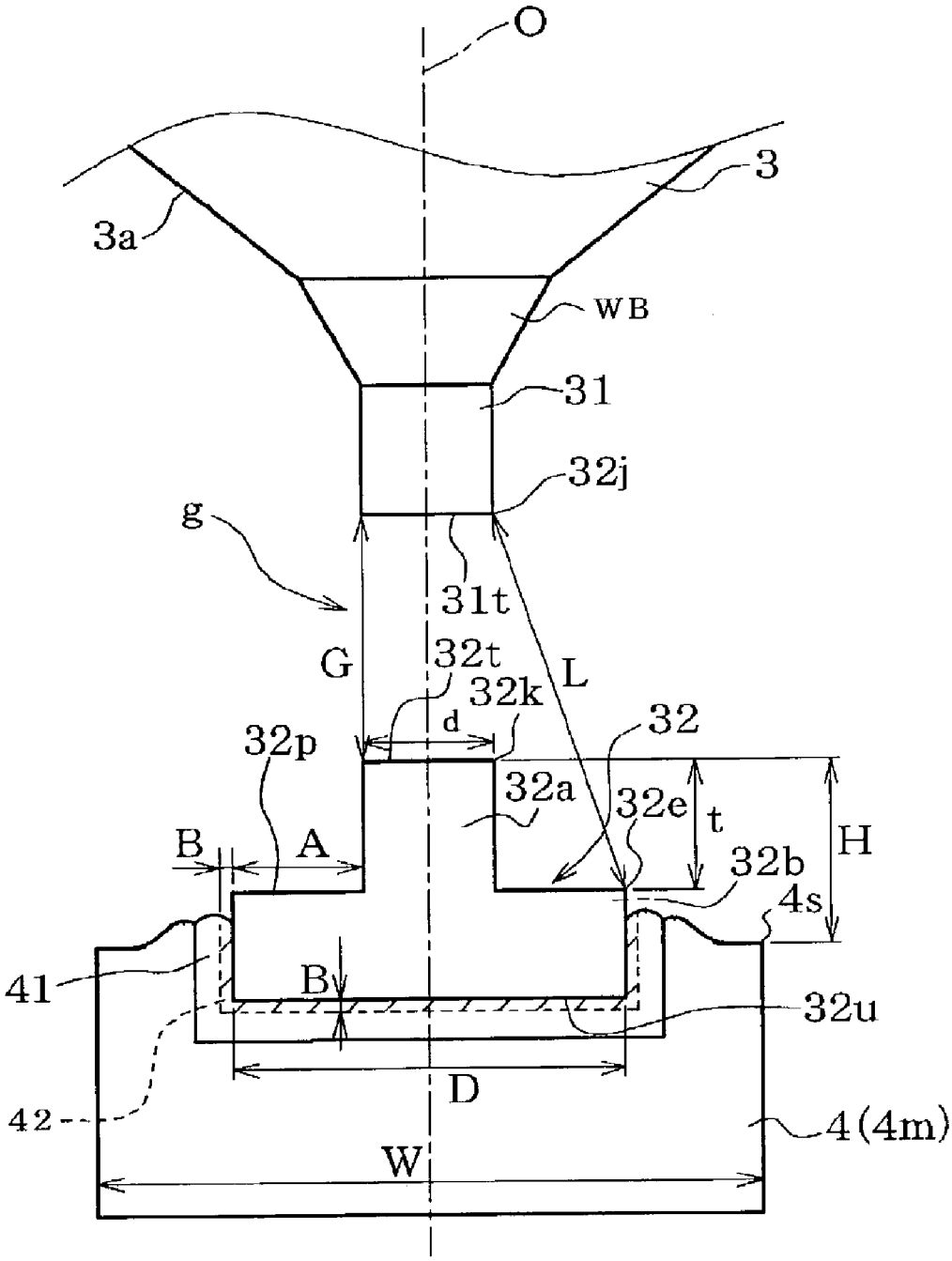
FIG. 17 is an enlarged front view showing a main portion of the spark plug of the second embodiment of the present invention.

In FIG. 17, a relaxation metal portion 41 is provided between the ground-electrode spark portion 32 and the ground electrode 4. The relaxation metal portion 41 has a coefficient of linear expansion falling between that of the metal that constitutes the ground electrode 4 and that of the noble metal that constitutes the ground-electrode spark portion 32, and is of, for example, a Pt—Ni alloy (however, the Pt—Ni alloy is lower in Pt content and higher in Ni content than the ground-electrode spark portion 32).

A first alloy layer 42 which has a thickness B ranging from 0.5 μm to 100 μm and in which the metal that constitutes the ground-ground spark portion 32 and the metal that constitutes the relaxation metal portion 41 are alloyed with each other is formed between the ground-electrode spark portion 32 and the relaxation metal portion 41. Thus, employment of the relaxation metal portion 41 intervening between the ground-electrode spark portion 32 and the ground electrode 4 suppresses separation of the ground-electrode spark portion to a greater extent.

Next, a method for manufacturing the spark plug of the second embodiment will be described.

Figure 4:
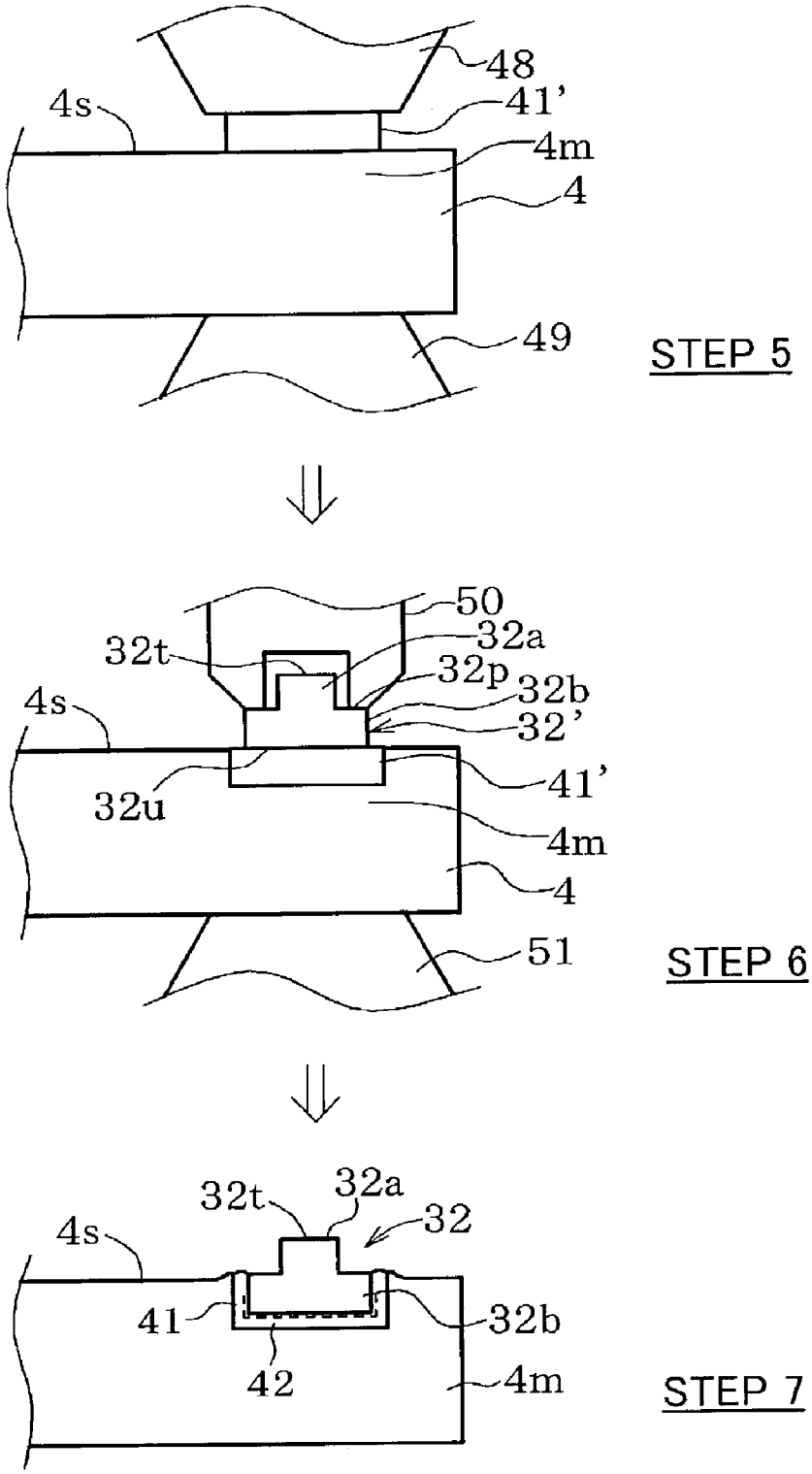
FIG. 4 is an explanatory view showing a process for manufacturing a spark plug of a second embodiment of the present invention.

FIG. 4 shows a method for forming the ground-electrode spark portion 32. Specifically, as shown in Step 5 of FIG. 4, a second noble metal chip 41' which is to become the relaxation metal portion 41 is placed on the side surface 4*s* of the ground electrode 4; and the resultant assembly is held under pressure between electrodes 48 and 49 and caused to generate heat through conduction of electricity, thereby joining the second noble metal chip 41' to the electrode base metal 4*m*. In the second embodiment, in order to enhance joining strength, joining is performed while the second noble metal chip 41' is caused to penetrate into the electrode base metal 4*m*. Next, as shown in Step 6, a noble metal chip 32' which is used to form a ground-electrode spark portion 32 and is smaller in diameter than the second noble metal chip 41' is placed on the second noble metal chip 41' which is used to form the relaxation metal portion 41; and the resultant assembly is held under pressure and caused to generate heat through conduction of electricity, thereby joining the noble metal chip 32' to the second noble metal chip 41'. Also, in this case, joining is performed while the noble metal chip 32' is caused to penetrate into the second noble metal chip 41'. As a result of these steps being carried out, as shown in Step 7, the second noble metal chip 41' and the noble metal chip 32' become the relaxation metal portion 41 and the ground-electrode spark portion 32, respectively.

Modified examples of the spark plug of the present invention will next be described.

Figure 6:
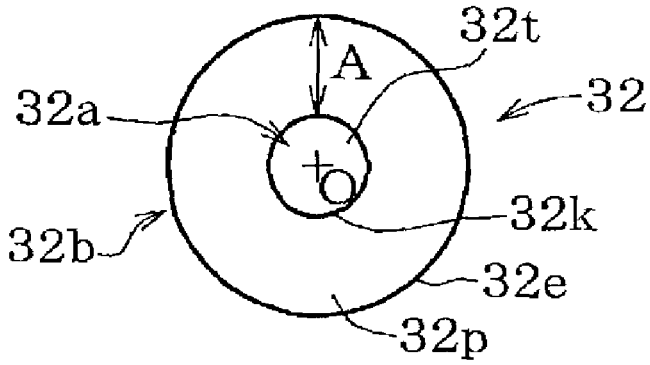
FIG. 6 is a plan view and side view showing a first modified example of FIG. 5.
Figure 6:
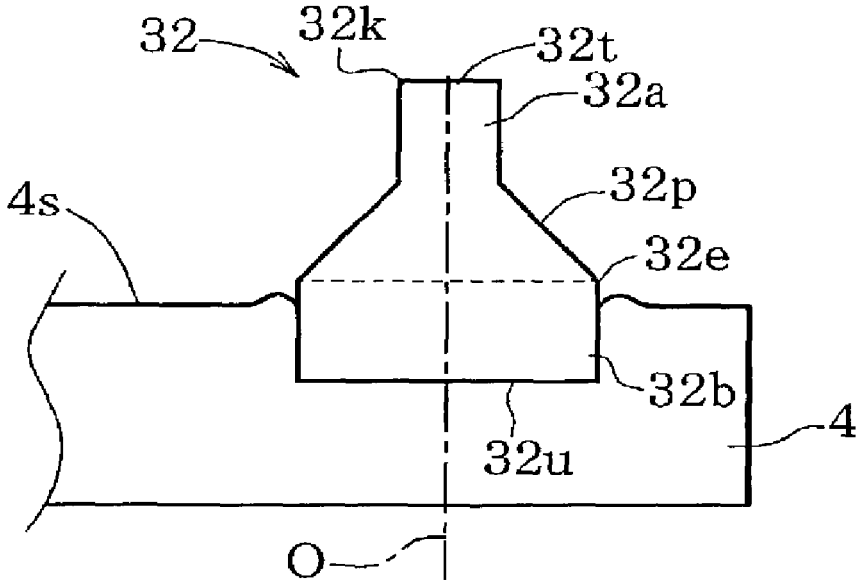
Figure 7:
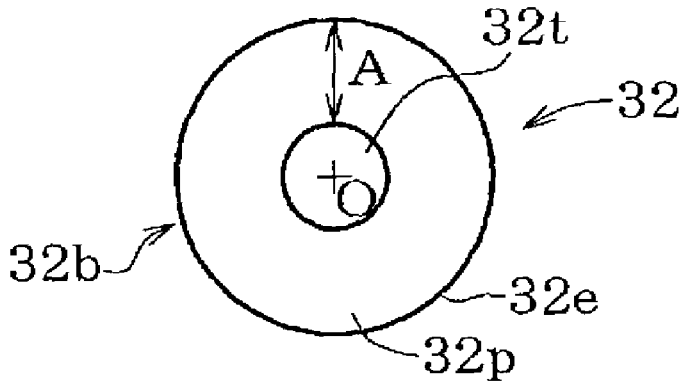
FIG. 7 is a plan view and side view showing a second modified example of FIG. 5.
Figure 7:
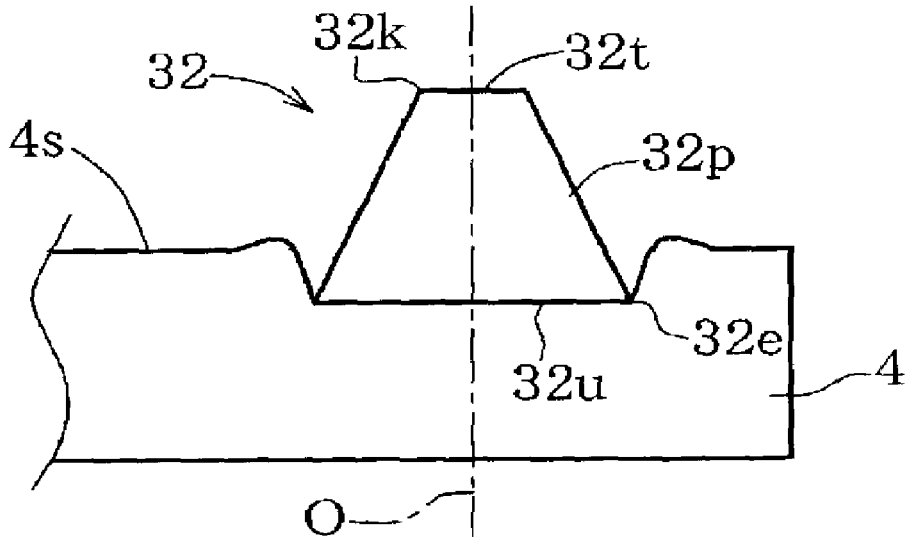
Figure 8:
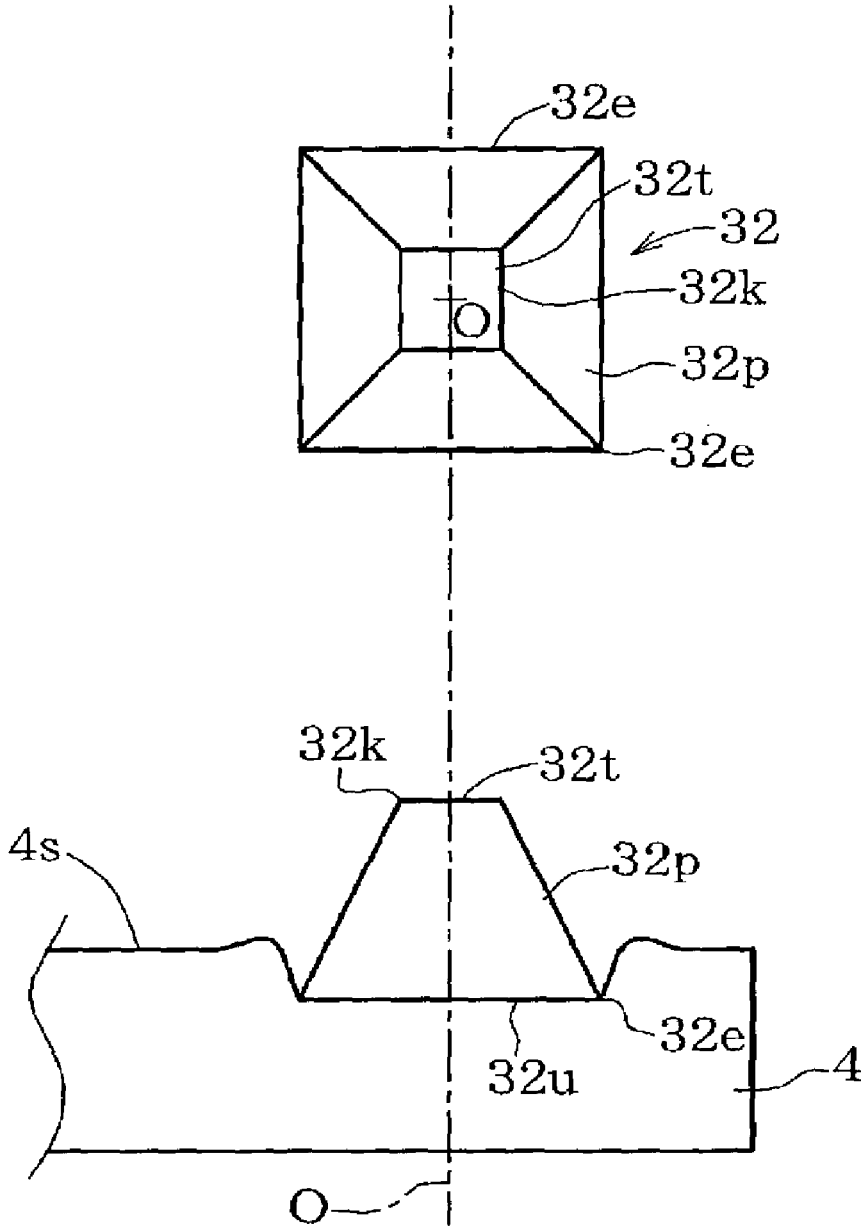
FIG. 8 is a plan view and side view showing a third modified example of FIG. 5.

First, the shape of the ground-electrode spark portion 32 is not limited to that shown in FIG. 2 or 5, but may be modified variously so long as the distal end surface 32*t* which faces the spark discharge gap g is smaller in diameter than the bottom surface 32*u* which is joined to the ground electrode. For example, FIG. 6 shows an example of the top surface 32*p*, which serves as the peripheral exposed-region surface, of the body portion 32*b*, the top surface 32*p* assuming the form of a tapered surface. FIGS. 7 and 8 exemplify shapes in which the body portion 32*b* and the protrusive portion 32*a* are not distinguished from each other. FIG. 7 shows an example in which the ground-electrode spark portion 32 assumes the shape of a truncated circular cone, and FIG. 8 shows an example in which the ground-electrode spark portion 32 assumes the shape of a truncated pyramid. In either case, the side surface serves as the peripheral exposed-region surface 32*p*. As in the case of FIG. 8, when the peripheral exposed-region surface 32*p* assumes an outline in a general shape other than a circular shape, the width A of the peripheral exposed-region surface 32*p* is defined as described below with reference to a plan view of the ground-electrode spark portion 32. The radius of a first circle having a circumferential length equal to the length of the peripheral edge 32*k* of the distal end surface 32*t* is represented by r1, and a second circle concentric with the first circle is determined such that the area of an annular region between the first and second circles is equal to the area of the peripheral exposed-region surface 32*p* appearing on the plan view. When the radius of the second circle is represented by r2, the width A of the peripheral exposed-region area 32*p* is defined by use of the above-mentioned radius r1 of the first circle as follows:

$$A \equiv r2 - r1 \tag{3}$$

Figure 18:
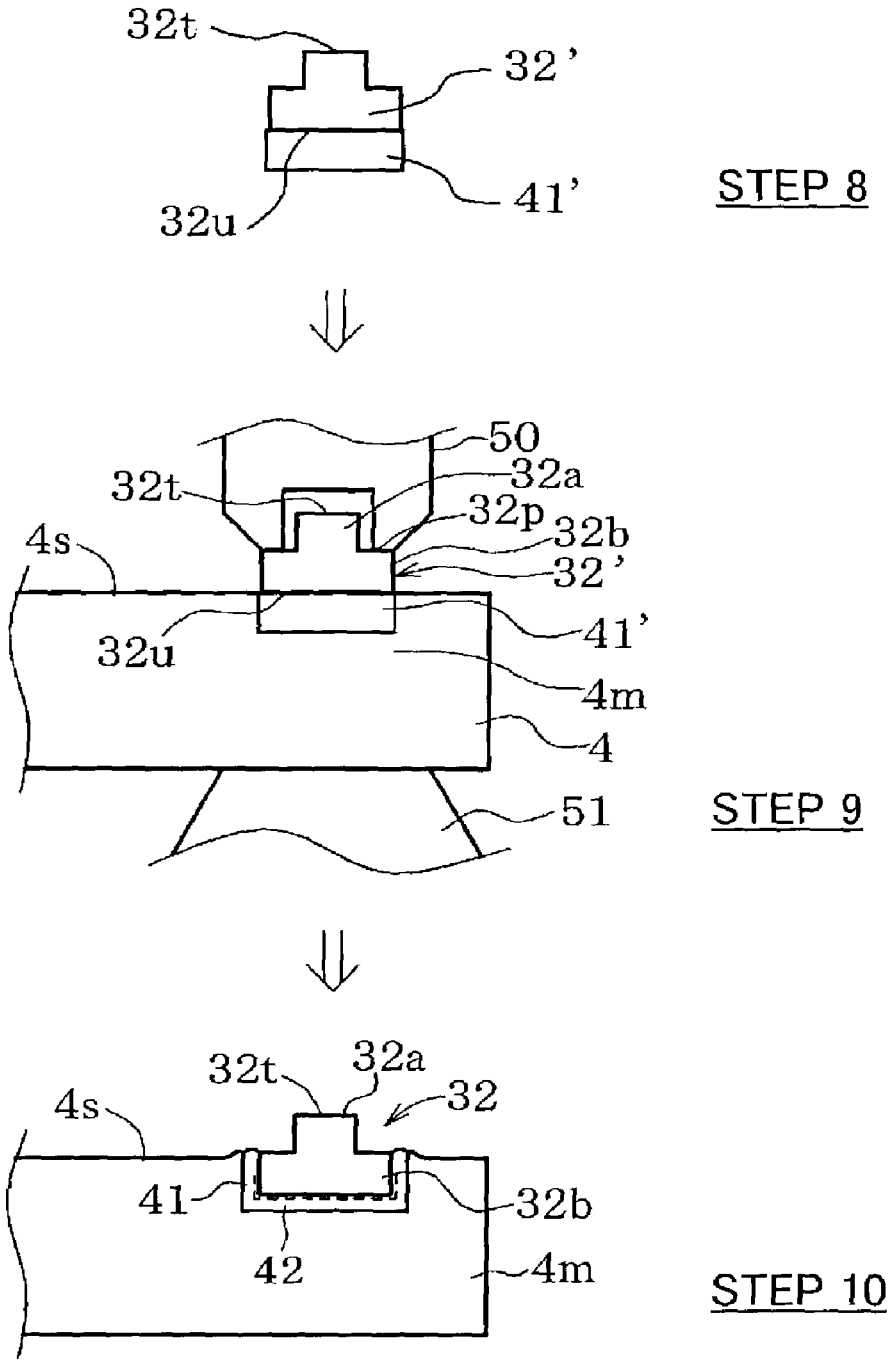
FIG. 18 is an explanatory view showing a process for manufacturing a modified example of the spark plug of the present invention.

In the second embodiment, a manufacturing method is employed in which the second noble metal chip 41' is resistance-welded to the electrode base metal 4*m* of the ground electrode 4, and subsequently the noble metal chip 32' is joined to the second noble metal chip 41' joined to the ground electrode 4. However, the present invention is not limited thereto. The manufacturing method shown in FIG. 18 may be employed. As shown in FIG. 18, in Step 8, the second noble metal chip 41' is joined to the noble metal chip 32' by resistance welding or a like joining method. In Step 9, the second noble metal chip 41' to which the noble metal chip 32' is joined is placed on the electrode base metal 4*m* of the ground electrode 4 and is then welded to the electrode base metal 4*m* through resistance welding or the like. As shown in Step 10, the second noble metal chip 41' becomes the relaxation metal layer 41, and the noble metal chip 32' becomes the ground-electrode spark portion 32. Thus, the noble metal chip 32' can be reliably joined without deviating from the second noble metal chip 41'.

EXAMPLES

The invention is now explained in greater detail by reference to the following Examples which should not be construed as limiting the invention.

Various test samples of the spark plug 100 shown in FIGS. 1 and 2 were prepared in the following manner. The ground-electrode spark portion 32 shaped as shown in FIG. 2 was manufactured from a Pt-20% by mass Ir alloy by header working as shown in Steps 1 and 2 of FIG. 3 such that the body portion 32*b* had a thickness of 0.3 mm and a diameter D of 1.5 mm; the protrusive portion 32*a* had a height t of 0.1–2.0 mm; the distal end surface 32*t* had a diameter d of 0.3–1.5 mm; and the top surface (peripheral exposed-region surface 32*p*) had a width A of 0–0.7 mm. The resultant piece was resistance-welded to the ground electrode 4 formed from INCONEL 600, according to Steps 3 and 4 of FIG. 3. Resistance welding conditions were set such that the applied current was 900 A, and the applied load was 150 N. The welded ground-electrode spark portion 32, together with a portion located peripherally around the same, was cut and measured for Pt concentration distribution by EPMA surface analysis. The measurement revealed that an alloy layer having a thickness of about 1 μm was formed. The center-electrode spark portion 31 was formed through laser-welding a noble metal chip made from an Ir-20% by mass Rh alloy and having a diameter of 0.6 mm and a height of 0.8 mm to the distal end surface of the center electrode 3 made from INCONEL 600. By use of the ground electrode 4 and the center electrode 3, the spark plug 100 shown in FIG. 1 was assembled such that the spark discharge gap g has a gap length G of 1.1 mm.

By use of the above-described spark plug test samples, the following tests were conducted.

Ignition Test.

Each spark plug test sample was mounted on one cylinder of a 6-cylinder gasoline engine having a total displacement of 2,000 cc. The engine was operated under an idling condition of 700 rpm while the air-fuel ratio was being changed toward the lean side. An A/F value as measured when a HC spike occurred 10 times per three minutes was judged to be an ignition limit.

Spark Ablation Resistance Test.

Each spark plug test sample was mounted on a 6-cyliner gasoline engine having a total displacement of 2,000 cc. The engine was continuously operated for 100 hours at an engine speed of 5,000 rpm while throttles were completely opened. After the test, an increase in spark discharge gap was measured.

Ground Electrode Spark Landing Miss Percentage.

Each spark plug was mounted on a test chamber. The spark plug was caused to generate spark discharge 200 times at a discharge voltage of 20 kV while air was caused to flow at a speed of 10 m/s within the chamber. Sparking behavior was videoed by use of a high-speed video camera. The percentage of sparks landing off the peripheral exposed-region surface 32*p* of the ground-electrode spark portion 32 (ground electrode spark landing miss percentage) was obtained.

Figure 12:
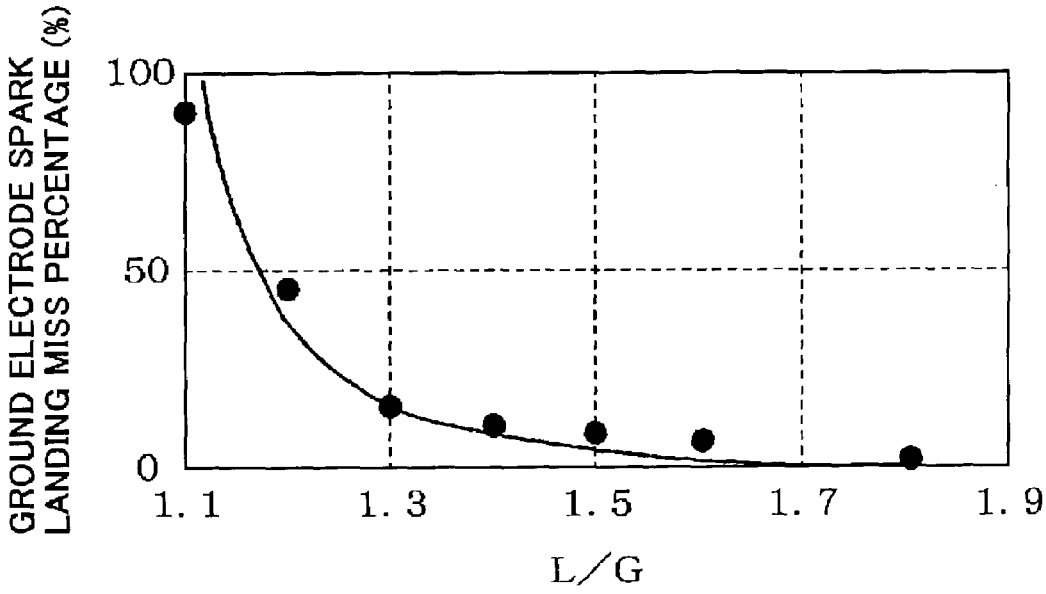
FIG. 12 is a graph showing a fourth result of the experiments for verifying the effects of the present invention.
Figure 13:
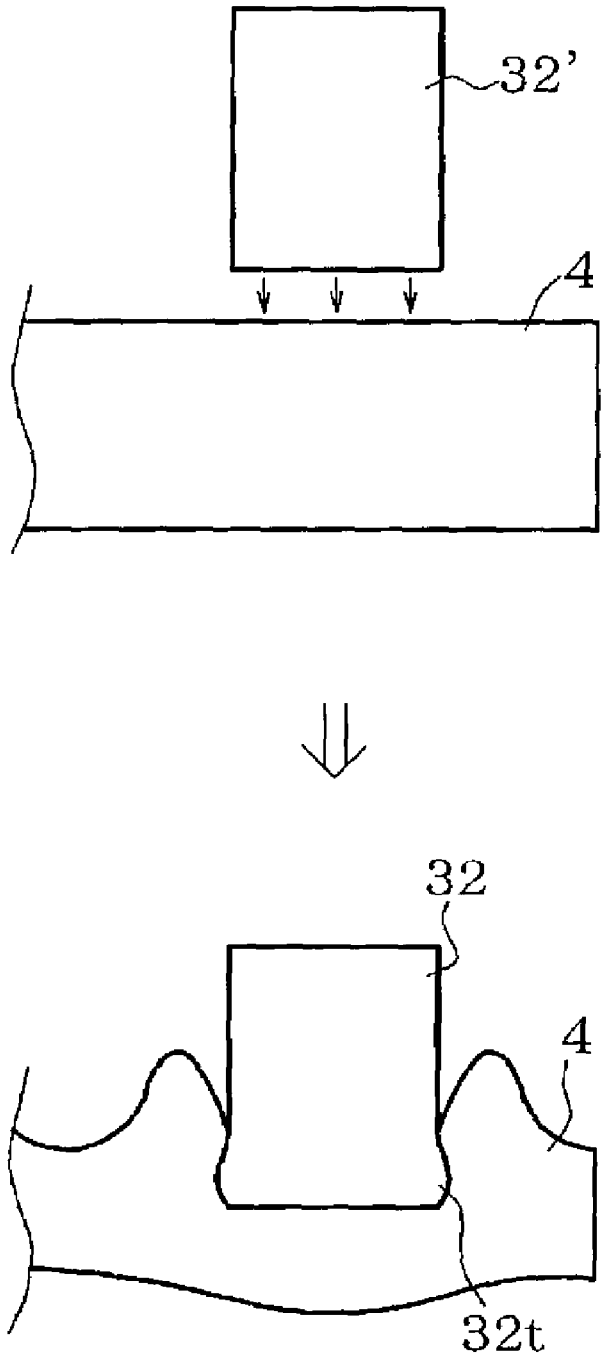
FIG. 13 is a first view showing a problem involved in a conventional spark plug.
Figure 14:
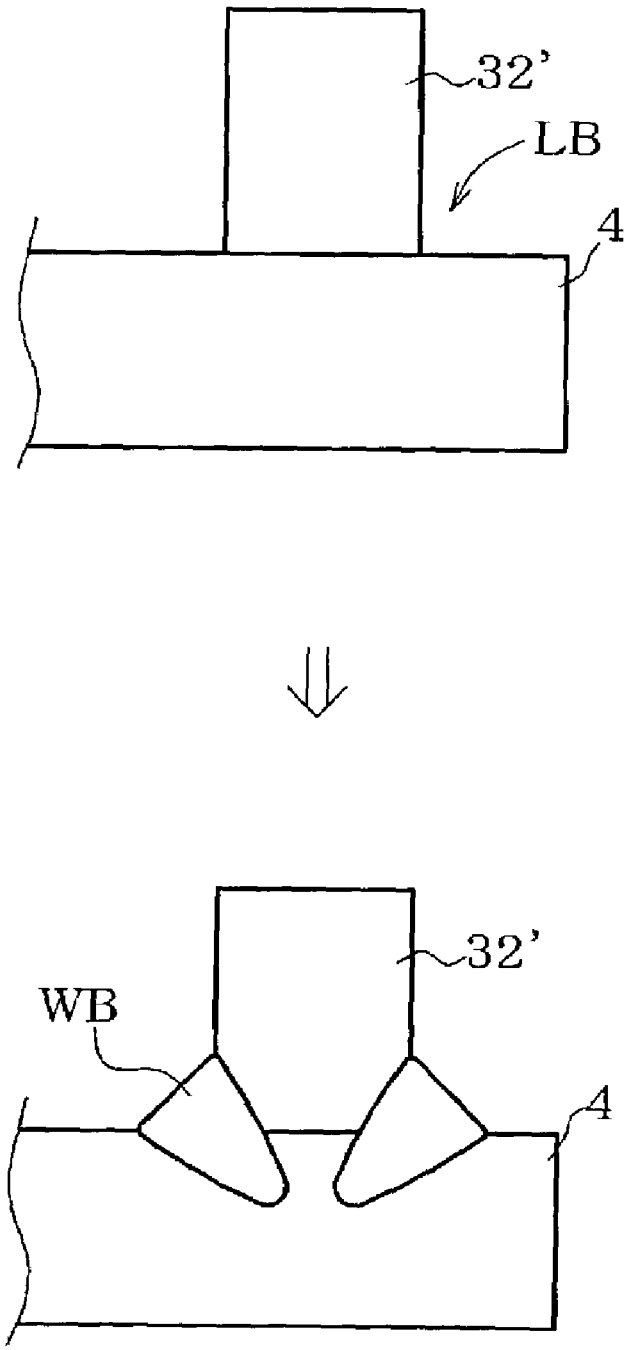
FIG. 14 is a second view showing a problem involved in a conventional spark plug.
Figure 15:
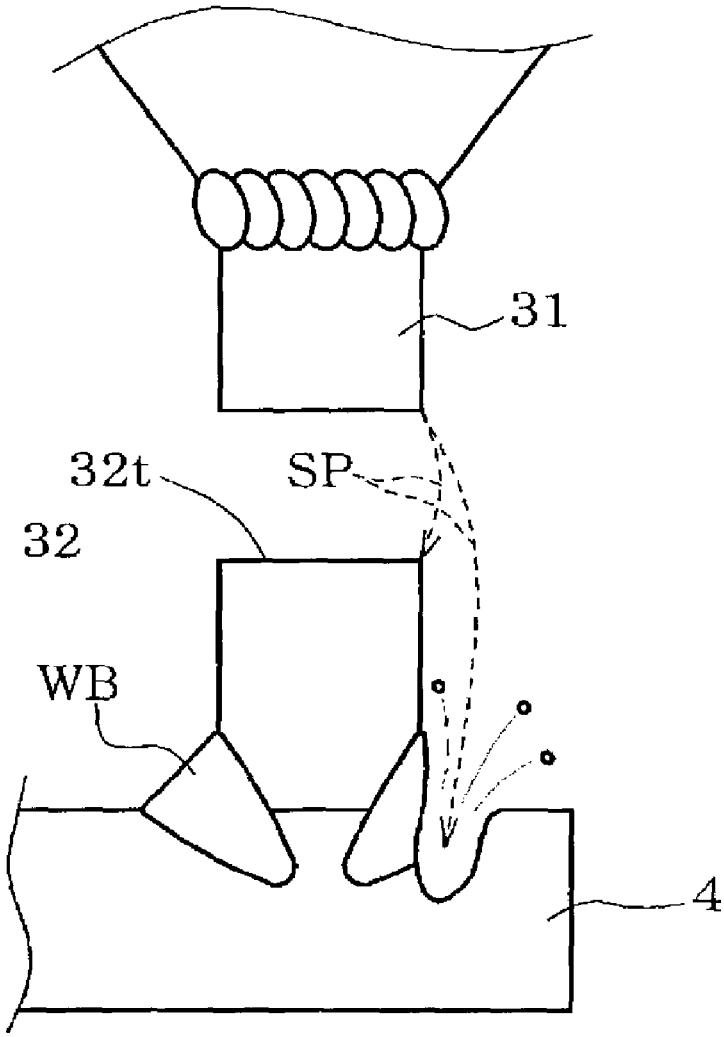
FIG. 15 is a third view showing a problem involved in a conventional spark plug.

FIG. 12 is a graph showing how the ground electrode spark landing miss percentage changes with L/G. Notably, the diameter d of the distal end surface 32*t* was 0.6 mm, and the width A of the peripheral exposed-region surface was 0.2 mm. As is apparent from the graph, when L/G is 1.3 or greater, the probability that a spark lands off the peripheral exposed-region surface 32*p* is sufficiently lowered, thereby favorably preventing uneven ablation of the ground electrode.

Figure 19:
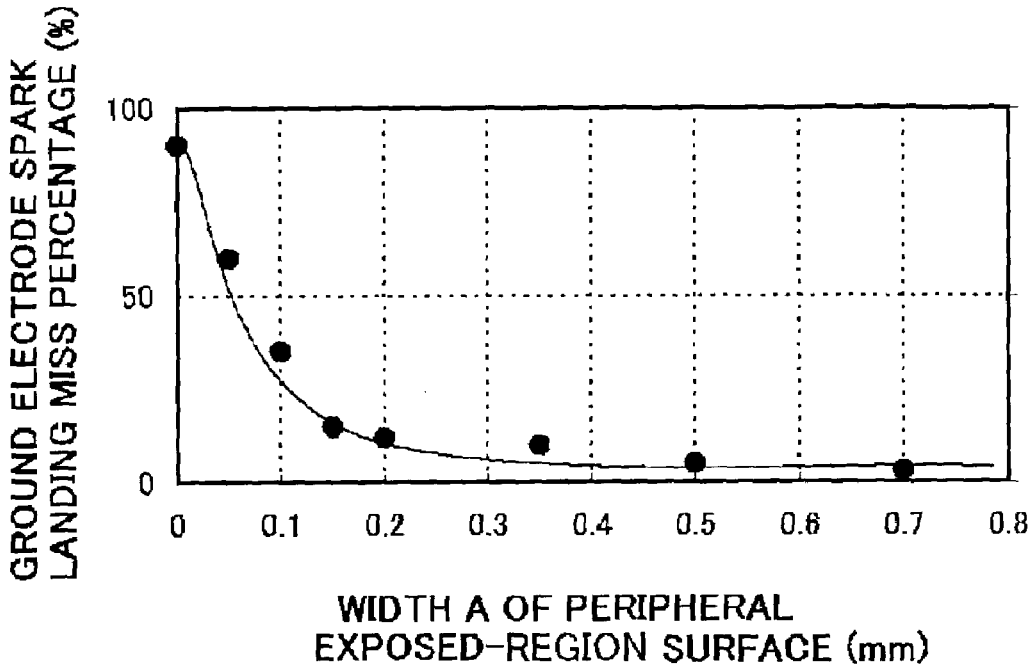
FIG. 19 is a graph showing a sixth result of the experiments for verifying the effects of the present invention.

FIG. 19 is a graph showing how the ground electrode spark landing miss percentage changes with the width A of the peripheral exposed-region surface 32*p*. Notably, the diameter d of the distal end surface 32*t* was 0.6 mm, and L was 1.9G. As is apparent from the graph, when the width A of the peripheral exposed-region surface 32*p* is 0.15 mm or greater, the probability that a spark lands off the peripheral exposed-region surface 32*p* is sufficiently lowered, thereby favorably preventing uneven ablation of the ground electrode.

Figure 9:
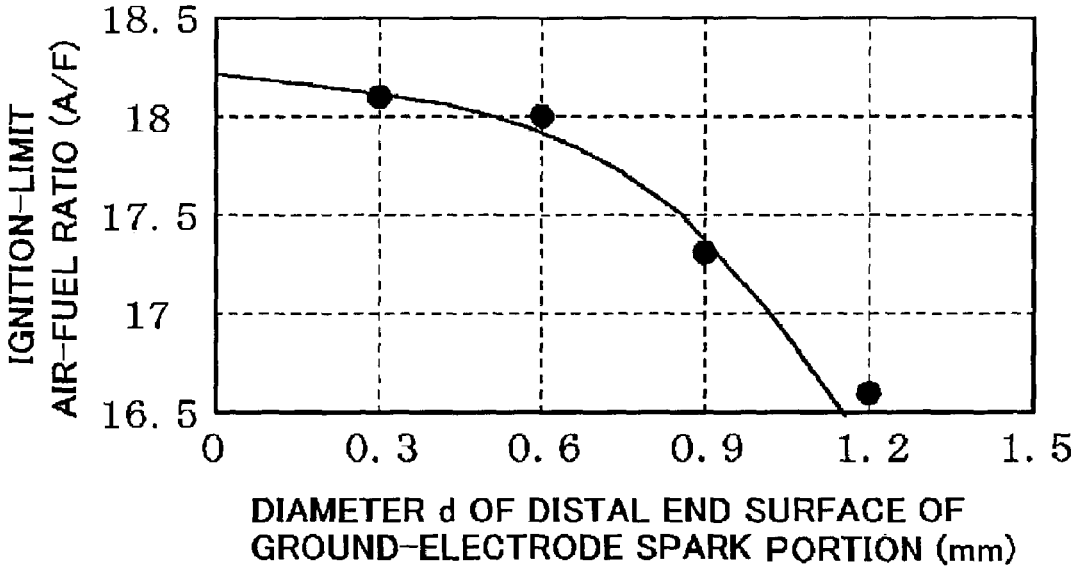
FIG. 9 is a graph showing a first result of experiments for verifying the effects of the present invention.

FIG. 9 is a graph showing how the ignition-limit air-fuel ratio changes with the diameter d of the distal end surface 32*t* of the ground-electrode spark portion 32. Notably, the width A of the peripheral exposed-region surface was 0.2 mm; the protrusive height of the distal end surface 32*t* was 0.8 mm; and L≧1.3G. As is apparent from the graph, when the diameter d of the distal end surface 32*t* is in excess of 0.9 mm, the limit air-fuel ratio shifts toward the rich side, indicating that ignition performance is impaired.

Figure 10:
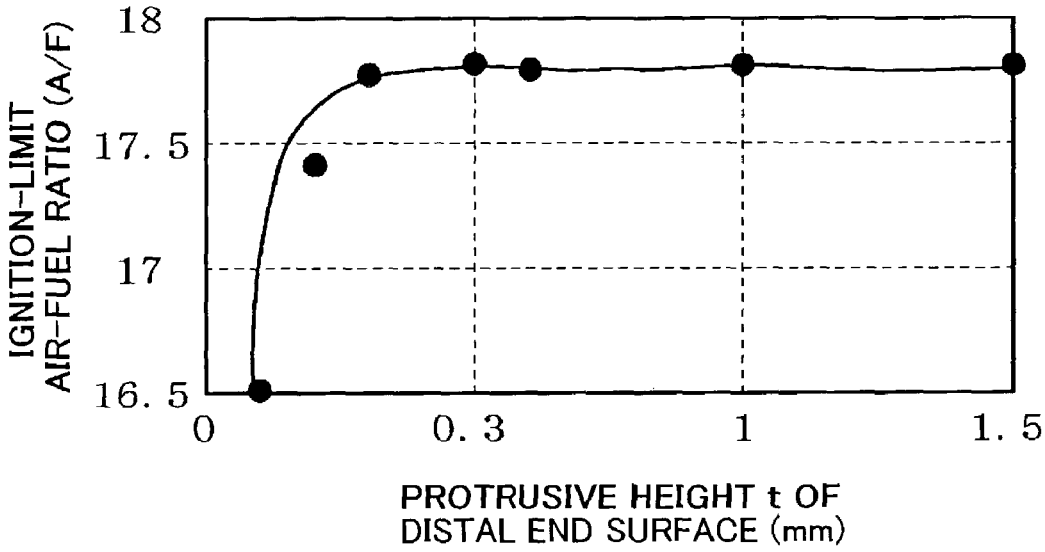
FIG. 10 is a graph showing a second result of the experiments for verifying the effects of the present invention.

FIG. 10 is a graph showing how the ignition-limit air-fuel ratio changes with the protrusive height t of the distal end surface 32*t*. Notably, the diameter d of the distal end surface 32*t* was 0.6 mm; the width A of the peripheral exposed-region surface was 0.2 mm; and L≧1.3G. As is apparent from the graph, when the protrusive height t is less than 0.3 mm, the limit air-fuel ratio shifts towards the rich side, indicating that ignition performance is impaired.

Figure 11:
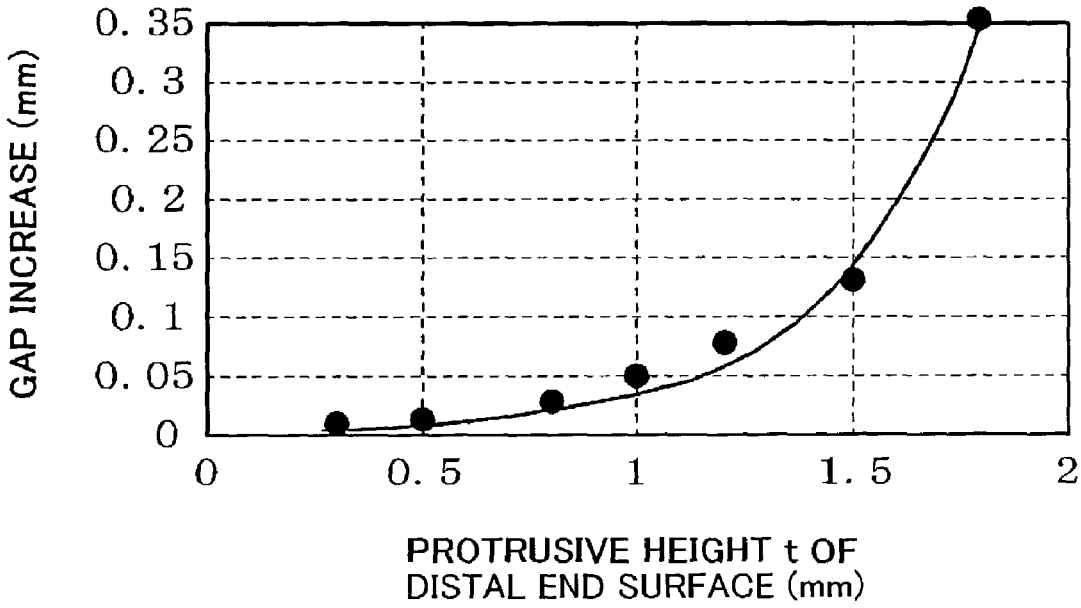
FIG. 11 is a graph showing a third result of the experiments for verifying the effects of the present invention.

FIG. 11 is a graph showing how the quantity of gap increase changes with protrusive height t. Notably, the diameter d of the distal end surface 32*t* was 0.6 mm; the width A of the peripheral exposed-region surface was 0.2 mm; and L≧1.3G. As is apparent from the graph, when the protrusive height t of the distal end surface 32*t* exceeds 1.5 mm, the quantity of gap increase becomes extremely large, indicating that spark ablation resistance is not sufficiently secured.

Figure 16:
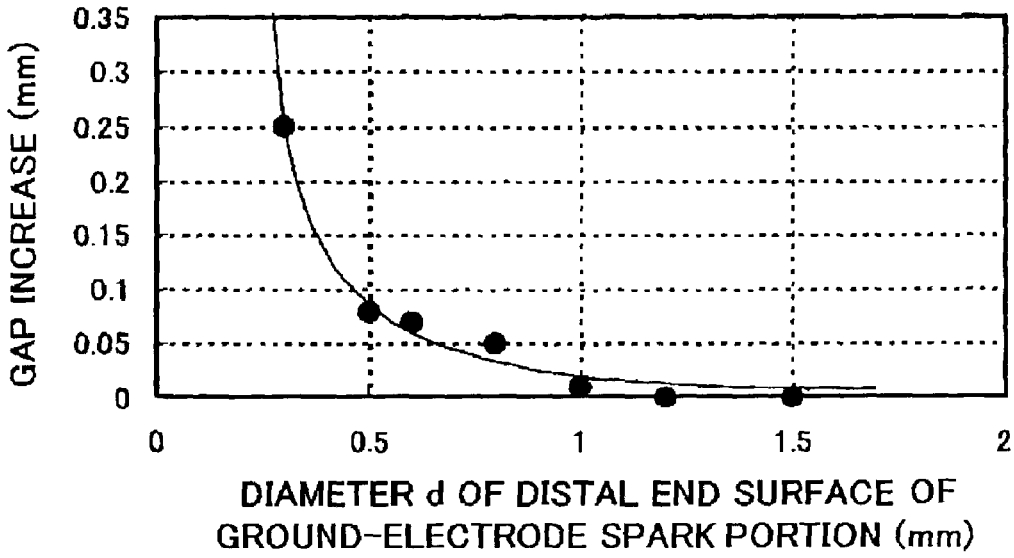
FIG. 16 is a graph showing a fifth result of the experiments for verifying the effects of the present invention.

FIG. 16 is a graph showing how the quantity of gap increase changes with the diameter d of the distal end surface 32*t* of the ground-electrode spark portion 32 in the spark ablation resistance test. Notably, the width A of the peripheral exposed-region surface was 0.2 mm; the protrusive height of the distal end surface 32*t* was 0.8 mm; and L≦1.3G. As is apparent from the graph, when the diameter d of the distal end surface 32*t* is less than 0.3 mm, the quantity of gap increase increases considerably, indicating that spark ablation resistance is not sufficiently secured.

It should be further be apparent to those skilled in the art that various changes in form in detail of the invention as shown and described above may be made. It is intended that such changes be included within the spirit and scope of the claims appended hereto.

This application is based on Japanese Patent Application No. 2002-181982 filed Jun. 21, 2002, incorporated herein by reference in its entirety.

What is claimed is:

1. A spark plug comprising:

a ground-electrode spark portion fixedly attached to a side surface of a ground electrode, which ground-electrode spark portion is disposed to face a center-electrode spark portion made from a noble metal and fixedly attached to a distal end of a center electrode, thereby forming a spark discharge gap between the center-electrode spark portion and the ground-electrode spark portion;

the ground-electrode spark portion is formed from a noble metal which contains Pt as a main component, and is joined to the ground electrode via an alloy layer which has a thickness ranging from 0.5 μm to 100 μm and in which the noble metal that constitutes the ground-electrode spark portion and a metal that constitutes the ground electrode are alloyed with each other; and the ground-electrode spark portion is configured such that the distal end surface facing the spark discharge gap is smaller in diameter than a bottom surface fixedly attached to the ground electrode; the distal end surface is protrusively located closer to the distal end of the center electrode than is the side surface of the ground electrode; and when the ground-electrode spark portion is viewed in plane from the distal end surface, a portion of a surface of the ground-electrode spark portion is viewed as a peripheral exposed-region surface which is exposed on the side surface of the ground electrode so as to surround the distal end surface, wherein the entire peripheral exposed-region surface is located closer to the center electrode than is the side surface of the ground electrode, wherein the peripheral exposed-region surface of the ground electrode-spark portion is formed in parallel with the distal end surface of the ground-electrode spark portion, wherein, when G represents a shortest distance along an axial direction of the center electrode between a distal end surface of the center-electrode spark portion and the distal end surface of the ground-electrode spark portion, and L represents a length of a line segment connecting, by a shortest distance, a peripheral edge of the distal end surface of the center-electrode spark portion and a peripheral edge of the peripheral exposed-region surface, the following relational expression is satisfied:

$1.3G \leqq L \leqq 3G$; and when, in orthogonal projection on a plane perpendicularly intersecting an axis of the center electrode, A represents a width of the peripheral exposed-region surface, W represents a width of the ground electrode, and d represents a diameter of the distal end surface of the ground-electrode spark portion, the following relational expression is satisfied:

$0.15 \leqq A \leqq \{(W-d)/2\}-0.4$(unit: mm).

2. The spark plug as claimed in claim 1, wherein the diameter d of the distal end surface of the ground-electrode spark portion assumes a value ranging from 0.3 mm to 0.9 mm.

3. The spark plug as claimed in claim 1, wherein, when the peripheral edge of the peripheral exposed-region surface serves as a reference position, a protrusive height t of the distal end surface of the ground-electrode spark portion assumes a value ranging from 0.3 mm to 1.5 mm as measured along the axial direction of the center electrode from the reference position toward the distal end surface of the center electrode.

4. A spark plug comprising:

a ground-electrode spark portion fixedly attached, via a relaxation metal portion, to a side surface of a ground electrode, which ground-electrode spark portion is disposed to face a center-electrode spark portion made from a noble metal and fixedly attached to a distal end of a center electrode, thereby forming a spark discharge gap between the center-electrode spark portion and the ground-electrode spark portion;

the ground-electrode spark portion is formed from a noble metal which contains Pt as a main component, and the relaxation metal portion is formed from a metal having a coefficient of linear expansion falling between that of a metal that constitutes the ground electrode and that of the noble metal that constitutes the ground-electrode spark portion;

a first alloy layer which has a thickness ranging from 0.5 μm to 100 μm and in which the noble metal that constitutes the ground-electrode spark portion and the metal that constitutes the relaxation metal portion are alloyed with each other is formed between the ground-electrode spark portion and the relaxation metal portion; and a distal end surface of the ground-electrode spark portion is configured such that the distal end surface facing the spark discharge gap is smaller in diameter than a bottom surface fixedly attached to the relaxation metal portion; the distal end surface is protrusively located closer to the distal end of the center electrode than is the side surface of the ground electrode; and when the ground-electrode spark portion is viewed in plane from the distal end surface, a portion of a surface of the ground-electrode spark portion is viewed as a peripheral exposed-region surface which is exposed on the side surface of the ground electrode so as to surround the distal end surface, wherein the entire peripheral exposed-region surface is located closer to the center electrode than is the side surface of the ground electrode, wherein the peripheral exposed-region surface of the ground electrode-spark portion is formed in parallel with the distal end surface of the ground-electrode spark portion, wherein, when G represents a shortest distance along an axial direction of the center electrode between a distal end surface of the center-electrode spark portion and the distal end surface of the ground-electrode spark portion, and L represents a length of a line segment connecting, by a shortest distance, a peripheral edge of the distal end surface of the center-electrode spark portion and a peripheral edge of the peripheral exposed-region surface, the following relational expression is satisfied:

$1.3G \leqq L \leqq 3G$; and when, in orthogonal projection on a plane perpendicularly intersecting an axis of the center electrode, A represents a width of the peripheral exposed-region surface, W represents a width of the ground electrode, and d represents a diameter of the distal end surface of the ground-electrode spark portion, the following relational expression is satisfied:

$0.15 \leqq A \leqq \{(W-d)/2\}-0.4$(unit: mm).

5. The spark plug as claimed in claim 4, wherein the diameter d of the distal end surface of the ground-electrode spark portion assumes a value ranging from 0.3 mm to 0.9 mm.

6. The spark plug as claimed in claim 4, wherein, when the peripheral edge of the peripheral exposed-region surface serves as a reference position, a protrusive height t of the distal end surface of the ground-electrode spark portion assumes a value ranging from 0.3 mm to 1.5 mm as measured along the axial direction of the center electrode from the reference position toward the distal end surface of the center electrode.

7. A method for manufacturing a spark plug, the spark plug comprising:

a ground-electrode spark portion fixedly attached to a side surface of a ground electrode, which ground-electrode spark portion is disposed to face a center-electrode spark portion made from a noble metal and fixedly attached to a distal end of a center electrode, thereby forming a spark discharge gap between the center-electrode spark portion and the ground-electrode spark portion;

the ground-electrode spark portion is formed from a noble metal which contains Pt as a main component, and is joined to the ground electrode via an alloy layer which has a thickness ranging from 0.5 μm to 100 μm and in which the noble metal that constitutes the ground-electrode spark portion and a metal that constitutes the ground electrode are alloyed with each other; and the ground-electrode spark portion is configured such that the distal end surface facing the spark discharge gap is smaller in diameter than a bottom surface fixedly attached to the ground electrode; the distal end surface is protrusively located closer to the distal end of the center electrode than is the side surface of the ground electrode; and when the ground-electrode spark portion is viewed in plane from the distal end surface, a portion of a surface of the ground-electrode spark portion is viewed as a peripheral exposed-region surface which is exposed on the side surface of the ground electrode so as to surround the distal end surface, wherein the entire peripheral exposed-region surface is located closer to the center electrode than is the side surface of the ground electrode, wherein the peripheral exposed-region surface of the ground electrode-spark portion is formed in parallel with the distal end surface of the ground-electrode spark portion, wherein, when G represents a shortest distance along an axial direction of the center electrode between a distal end surface of the center-electrode spark portion and the distal end surface of the ground-electrode spark portion, and L represents a length of a line segment connecting, by a shortest distance, a peripheral edge of the distal end surface of the center-electrode spark portion and a peripheral edge of the peripheral exposed-region surface, the following relational expression is satisfied:

$$1.3G \leqq L \leqq 3G; \text{ and}$$

when, in orthogonal projection on a plane perpendicularly intersecting an axis of the center electrode, A represents a width of the peripheral exposed-region surface, W represents a width of the ground electrode, and d represents a diameter of the distal end surface of the ground-electrode spark portion, the following relational expression is satisfied:

$$0.15 \leqq A \leqq \{(W-d)/2\}-0.4 \text{(unit: mm)};$$

the method comprising:

a chip manufacturing step for manufacturing a noble metal chip, which is to serve as the ground-electrode spark portion and in which a distal end surface is smaller in diameter than a bottom surface, by machining a noble metal which contains Pt as a main component, prior to joining the noble metal chip to the ground electrode; and a resistance welding step in which the manufactured noble metal chip is placed on the ground electrode such that the bottom surface is in contact with the ground electrode; and the noble metal chip and the ground electrode are joined by resistance welding while a force for bringing the noble metal chip and the ground electrode into close contact with each other is selectively applied to a chip surface which serves as a peripheral region of the distal end surface when the noble metal chip is viewed in plane from the distal end surface.

8. A method for manufacturing a spark plug, the spark plug comprising:

a ground-electrode spark portion fixedly attached, via a relaxation metal portion, to a side surface of a ground electrode, which ground-electrode spark portion is disposed to face a center-electrode spark portion made from a noble metal and fixedly attached to a distal end of a center electrode, thereby forming a spark discharge gap between the center-electrode spark portion and the ground-electrode spark portion;

the ground-electrode spark portion is formed from a noble metal which contains Pt as a main component, and the relaxation metal portion is formed from a metal having a coefficient of linear expansion falling between that of a metal that constitutes the ground electrode and that of the noble metal that constitutes the ground-electrode spark portion;

a first alloy layer which has a thickness ranging from 0.5 μm to 100 μm and in which the noble metal that constitutes the ground-electrode spark portion and the metal that constitutes the relaxation metal portion are alloyed with each other is formed between the ground-electrode spark portion and the relaxation metal portion; and a distal end surface of the ground-electrode spark portion is configured such that the distal end surface facing the spark discharge gap is smaller in diameter than a bottom surface fixedly attached to the relaxation metal portion; the distal end surface is protrusively located closer to the distal end of the center electrode than is the side surface of the ground electrode; and when the ground-electrode spark portion is viewed in plane from the distal end surface, a portion of a surface of the ground-electrode spark portion is viewed as a peripheral exposed-region surface which is exposed on the side surface of the ground electrode so as to surround the distal end surface, wherein the entire peripheral exposed-region surface is located closer to the center electrode than is the side surface of the ground electrode, wherein the peripheral exposed-region surface of the ground electrode-spark portion is formed in parallel with the distal end surface of the ground-electrode spark portion, wherein, when G represents a shortest distance along an axial direction of the center electrode between a distal end surface of the center-electrode spark portion and the distal end surface of the ground-electrode spark portion, and L represents a length of a line segment connecting, by a shortest distance, a peripheral edge of the distal end surface of the center-electrode spark portion and a peripheral edge of the peripheral exposed-region surface, the following relational expression is satisfied:

$$1.3G \leqq L \leqq 3G; \text{ and}$$

when, in orthogonal projection on a plane perpendicularly intersecting an axis of the center electrode, A represents a width of the peripheral exposed-region surface, W represents a width of the ground electrode, and d represents a diameter of the distal end surface of the ground-electrode spark portion, the following relational expression is satisfied:

$$0.15 \leqq A \leqq \{(W-d)/2\}-0.4 \text{(unit: mm)};$$

the method being characterized by comprising:

a chip manufacturing step for manufacturing a noble metal chip, which is to serve as the ground-electrode spark portion and in which a distal end surface is smaller in diameter than a bottom surface, by machining a noble metal which contains Pt as a main component, prior to joining the noble metal chip to the ground electrode; and a joining step in which a second noble metal chip which is to serve as the relaxation metal portion and whose coefficient of linear expansion falls between that of a metal that constitutes the ground electrode and that of the noble metal that constitutes the ground-electrode spark portion is placed on the bottom surface of the manufactured noble metal chip; and the second noble metal chip and the manufactured noble metal chip are joined to form a first alloy layer which has a thickness ranging from 0.5 μm to 100 μm and in which the metal that constitutes the second noble metal chip and the metal that constitutes the manufactured noble metal chip are alloyed with each other.

9. The method for manufacturing a spark plug as claimed in claim 8, further comprising:

a resistance welding step in which, prior to the step for joining the second noble metal chip and the manufactured noble metal chip, the second noble metal chip is placed on the ground electrode; and the second noble metal chip and the ground electrode are joined by resistance welding while a force for bringing the second noble metal chip and the ground electrode into close contact with each other is selectively applied.

* * * * *